US010859057B2

(12) United States Patent
Ohno

(10) Patent No.: US 10,859,057 B2
(45) Date of Patent: Dec. 8, 2020

(54) INTERNAL COMBUSTION ENGINE IGNITION SYSTEM

(71) Applicant: DENSO CORPORATION, Kariya (JP)

(72) Inventor: Takashi Ohno, Kariya (JP)

(73) Assignee: DENSO CORPORATION, Kariya (JP)

( * ) Notice: Subject to any disclaimer, the term of this patent is extended or adjusted under 35 U.S.C. 154(b) by 0 days.

(21) Appl. No.: 16/656,923

(22) Filed: Oct. 18, 2019

(65) Prior Publication Data

US 2020/0049120 A1 Feb. 13, 2020

Related U.S. Application Data

(63) Continuation of application No. PCT/JP2018/015045, filed on Apr. 10, 2018.

(30) Foreign Application Priority Data

Apr. 20, 2017 (JP) ..... 2017-083816
Mar. 19, 2018 (JP) ..... 2018-051031

(51) Int. Cl.
*F02P 1/00* (2006.01)
*F02P 3/04* (2006.01)
*F02D 41/30* (2006.01)
*F02P 3/10* (2006.01)

(52) U.S. Cl.
CPC ..... *F02P 3/0407* (2013.01); *F02D 41/3023* (2013.01); *F02P 3/10* (2013.01)

(58) Field of Classification Search
CPC ..... F02P 3/045; F02P 3/0453; F02P 3/051; F02P 3/0853; F02P 9/002; F02P 3/01; F02P 3/05; F02P 3/12
USPC ..... 123/594, 609, 621; 361/253, 263
See application file for complete search history.

(56) References Cited

U.S. PATENT DOCUMENTS 4,998,526 A 3/1991 Gokhale
7,730,880 B1 * 6/2010 Nagai ..... F02P 15/08 123/620
2007/0267004 A1 11/2007 Yamauchi
(Continued)

FOREIGN PATENT DOCUMENTS

EP 2 325 476 5/2011
JP 2015-200249 11/2015
(Continued)

*Primary Examiner* — John Kwon
(74) *Attorney, Agent, or Firm* — Nixon & Vanderhye PC

(57) ABSTRACT

An internal combustion engine ignition system includes: a primary coil provided with a center tap; a third switching element that interrupts and conducts a primary current flowing from a voltage application unit to the center tap; a first switching element connected to one end on a first winding side; a second switching element connected to the other end on a second winding side; an ignition control circuit that controls operation of each of the above switching elements, thereby performing discharge generation control that allows an ignition plug to generate a spark discharge, and thereby interrupting and conducting the primary current flowing to the second winding to perform discharge maintenance control that maintains the spark discharge generated in the ignition plug; and a current circulation path that circulates a current flowing from the second winding to the second switching element.

37 Claims, 23 Drawing Sheets

(56) References Cited

U.S. PATENT DOCUMENTS

| | | | | |
|---|---|---|---|---|
| 2016/0061177 | A1* | 3/2016 | Ishitani | F02P 3/0435<br>123/623 |
| 2017/0045025 | A1 | 2/2017 | Nakayama et al. | |
| 2018/0119666 | A1* | 5/2018 | Nakamura | F02P 3/053 |
| 2018/0195485 | A1 | 7/2018 | Seimiya et al. | |
| 2018/0358782 | A1* | 12/2018 | Miyake | F02P 3/01 |
| 2019/0301422 | A1 | 10/2019 | Lorenz et al. | |
| 2020/0191107 | A1* | 6/2020 | Ohno | F02P 3/00 |
| 2020/0200138 | A1* | 6/2020 | Terada | F02P 15/10 |
| 2020/0200139 | A1* | 6/2020 | Ohno | F02P 9/00 |

FOREIGN PATENT DOCUMENTS

| | | |
|---|---|---|
| JP | 2015-200284 | 11/2015 |
| JP | 2016-53358 | 4/2016 |
| WO | 2016/157541 A1 | 10/2016 |

* cited by examiner

COMPARATIVE EXAMPLE

INTERNAL COMBUSTION ENGINE IGNITION SYSTEM

This application is a U.S. application under 35 U.S.C. 111(a) and 363 that claims the benefit under 35 U.S.C. 120 from International Application No. PCT/JP2018/015045 filed on Apr. 10, 2018, the entire contents of which are incorporated herein by reference. This application is also based on Japanese Patent Application No. 2017-083816 filed on Apr. 20, 2017, and Japanese Patent Application No. 2018-051031 filed on Mar. 19, 2018, the contents of which are incorporated herein by reference.

BACKGROUND

Technical Field

The present disclosure relates to an ignition system used for internal combustion engines.

Related Art

In order to improve fuel efficiency in internal combustion engines for vehicles, studies have recently been advanced on technologies related to combustion control of lean fuel (lean-burn engine) or EGR that circulates combustion gas to cylinders of internal combustion engines. With respect to these technologies, in order to effectively burn the fuel contained in the mixed gas, a continuous discharge system has been studied which allows an ignition plug to continuously generate a spark discharge for a fixed time period near the ignition timing.

SUMMARY

As an aspect of the embodiment, an internal combustion engine ignition system is provided which includes: an ignition plug that generates a spark discharge for igniting a combustible mixture in a combustion chamber of an internal combustion engine; an ignition coil including a primary coil and a secondary coil, and applying a voltage to the ignition plug by the secondary coil; a voltage application unit that applies a predetermined voltage to the primary coil; a third switching element conducting and interrupting a primary current flowing from the voltage application unit to a center tap provided in the middle of a winding that forms the primary coil; a first switching element connected between a ground side and one end of the winding forming the primary coil on a side of a first winding, which is a winding from the center tap to one end; a second switching element connected between the ground side and one end of the winding forming the primary coil on a side of a second winding, which is a winding from the center tap to the other end; an ignition control circuit that controls open and closed states of the first switching element, open and closed states of the second switching element, and open and closed states of the third switching element, thereby conducting and interrupting the primary current flowing to the first winding to perform discharge generation control that allows the ignition plug to generate the spark discharge, and thereby conducting and interrupting the primary current flowing to the second winding to perform discharge maintenance control that maintains the spark discharge generated in the ignition plug; and a current circulation path that circulates a current flowing from the second winding to the second switching element.

DETAILED DESCRIPTION OF THE PREFERRED EMBODIMENTS

Figure 1:
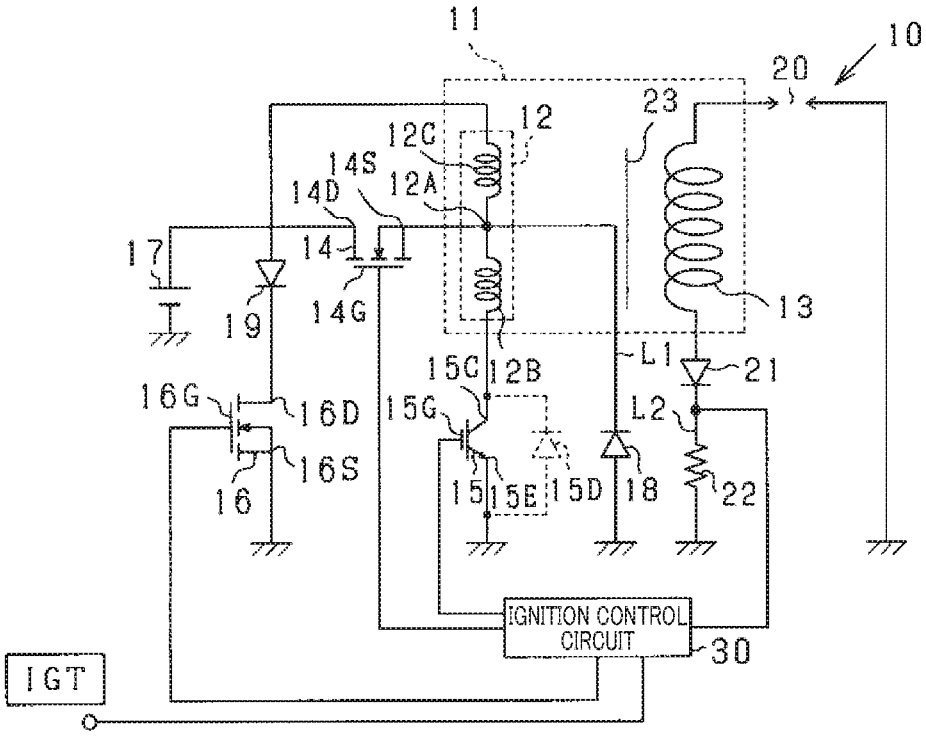
FIG. 1 is a schematic block diagram of an ignition system according to a first embodiment.

In order to improve fuel efficiency in internal combustion engines for vehicles, studies have recently been advanced on technologies related to combustion control of lean fuel (lean-burn engine) or EGR that circulates combustion gas to cylinders of internal combustion engines. With respect to these technologies, in order to effectively burn the fuel contained in the mixed gas, a continuous discharge system has been studied which allows an ignition plug to continuously generate a spark discharge for a fixed time period near the ignition timing.

As a continuous discharge ignition system, for example, as disclosed in JP 2015-200284 A, a center tap is provided in the middle of the winding of a primary coil; and after main ignition is started in an ignition plug, electrical energy is sequentially supplied to the center tap from a power source for supplying energy. Electrical energy is thereby supplied to the winding of the primary coil, only from the center tap to one end, and accordingly, a secondary current in the same direction as a secondary current produced by the main ignition sequentially additionally flows through the secondary coil, whereby the ignition plug continuously generates a spark discharge. Hereinafter, the winding of the primary coil from the center tap to one end is referred to as a second winding, and the winding of the primary coil from the center tap to the other end is referred to as a first winding. In this case, when the turn ratio of the second winding and the secondary coil is set to be large, it is possible to allow the secondary coil to generate a secondary voltage that allows the ignition plug to continuously generate a spark discharge, without using a voltage booster circuit.

In JP 2015-200284 A, an energy supply switching element is provided to turn on and off an energy supply line for supplying electrical energy to the center tap of the primary coil. Every time the energy supply switching element is turned on, the primary current additionally flows to the second winding via the center tap. In addition, the energy supply switching element is turned off to stop energy supply. While repeating this control, the secondary current is maintained at a predetermined value to increase ignition performance. However, the inventors of the present disclosure found that when the energy supply switching element was turned off, a decrease in the primary current was relatively large, and the secondary current rapidly decreased, so that it was not easy to maintain the secondary current at a predetermined value.

The present disclosure is made to solve the above problems, and a primary object of the present disclosure is to provide an internal combustion engine ignition system capable of suppressing a rapid decrease in the secondary current during a period of discharge maintenance control.

First Embodiment

The first embodiment is described with reference to the drawings. The present ignition system 10 is to be mounted to an internal combustion engine (hereinafter referred to as an engine) 60 (see FIG. 8). The configuration of the ignition system 10 will be described with reference to FIG. 1. The ignition system 10 is provided with an ignition plug 20, an ignition coil 11, a third switching element 14, a first switching element 15, a second switching element 16, a power supply unit (corresponding to a voltage application unit) 17, and an ignition control circuit 30.

The ignition coil 11 includes a primary coil 12, a secondary coil 13, and an iron core 23. A center tap 12A is provided in the middle of a winding that forms the primary coil 12. The center tap 12A is connected to the power supply unit 17 via the third switching element 14. Accordingly, when the third switching element 14 is in a closed state, a predetermined voltage is applied from the power supply unit 17 to the center tap 12A. Further, one end of the winding forming the primary coil 12 on a side of a first winding 12B, which is a winding with a larger number of turns from the center tap 12A to one end, is connected to the first switching element 15. One end of the winding forming the primary coil 12 on a side of a second winding 12C, which is a winding with a smaller number of turns from the center tap 12A to one end, is connected to the second switching element 16 via a third diode 19.

The third switching element 14 is a metal oxide semiconductor field effect transistor (MOSFET), and has a third control terminal 14G, a third power supply side terminal 14D, and a third ground side terminal 14S. The third switching element 14 is configured to control on/off of energization between the third power supply side terminal 14D and the third ground side terminal 14S based on a third control signal input to the third control terminal 14G. In the present embodiment, the third ground side terminal 14S is connected to the center tap 12A, and the third power supply side terminal 14D is connected to the power supply unit 17.

The first switching element 15 is an insulated gate bipolar transistor (IGBT), which is a MOS gate structure transistor, and has a first control terminal 15G, a first power supply side terminal 15C, and a first ground side terminal 15E. The first switching element 15 is configured to control on/off states of energization between the first power supply side terminal 15C and the first ground side terminal 15E based on a first control signal input to the first control terminal 15G. In the present embodiment, the first power supply side terminal 15C is connected to the first winding 12B. Further, the first ground side terminal 15E is grounded.

The second switching element 16 is a MOSFET, and has a second control terminal 16G, a second power supply side terminal 16D, and a second ground side terminal 16S. The second switching element 16 is configured to control on/off states of energization between the second power supply side terminal 16D and the second ground side terminal 16S based on a second control signal input to the second control terminal 16G. In the present embodiment, the second power supply side terminal 16D is connected to the second winding 12C via the third diode 19, and the second ground side terminal 16S is grounded. The details of the third diode 19 will be described later.

The center tap 12A is connected to the third switching element 14 and also connected to a current circulation path L1. The current circulation path L1 includes a first diode 18. The cathode side of the first diode 18 is connected to the center tap 12A, and the anode side of the first diode 18 is grounded.

A first end of the secondary coil 13 is connected to a current detection path L2 via a diode 21 that prevents flying sparks during energization of the primary coil (hereinafter referred to as a protective diode). The current detection path L2 is provided with a resistor 22 for secondary current detection. A first end of the resistor 22 is connected to the first end of the secondary coil 13 via the protective diode 21, and a second end of the resistor 22 is connected to the ground side. The protective diode 21 prevents a flow of current in the direction from the ground side to the second end side of the secondary coil 13 via the resistor 22, the current being generated when the first winding 12B is energized. This prevents frying sparks with on-voltage of the primary coil 12 generated when the primary coil 12 is energized. In addition, to define a secondary current (discharge current) I2 in the direction from the ignition plug 20 toward the secondary coil 13, the anode of the protective diode 21 is connected to the first end of the secondary coil 13.

The ignition control circuit 30 is connected to an engine ECU (control device; not shown) so as to receive an ignition signal IGt output from the engine ECU. The ignition signal IGt defines optimal ignition timing and secondary current (discharge current) according to the state of gas in the combustion chamber of the engine 60 and the required output of the engine 60. Moreover, the ignition control circuit 30 is connected to the third switching terminal 14G, the first control terminal 15G, and the second control terminal 16G so as to control opening and closing operation of the third switching element 14, the first switching element 15, and the second switching element 16, respectively.

The ignition control circuit 30 outputs drive signals IG1, IG2, and IG3 for controlling opening and closing of the third control terminal 14G of the third switching element 14, the first control terminal 15G of the first switching element 15, and the second control terminal 16G of the second switching element 16, respectively, based on the ignition signal IGt received from the engine ECU.

Accordingly, a flow path from the power supply unit 17 to the first winding 12B (see FIG. 2) is first formed, and the conduction and interruption of the primary current I1 flowing to the first winding 12B are then controlled, whereby discharge start control is performed to allow the ignition plug 20 to generate a spark discharge. After the discharge start control is performed, a flow path from the power supply unit 17 to the second winding 12C (see FIG. 3) is formed, and conduction and interruption of the primary current I1 flowing to the second winding 12C are then controlled, whereby discharge maintenance control is performed to maintain the spark discharge generated in the ignition plug 20. In this case, since the secondary current I2 flowing through the current detection path L2 is detected, the current detection path L2 and the ignition control circuit 30 correspond to a secondary current detection unit.

Figure 2:
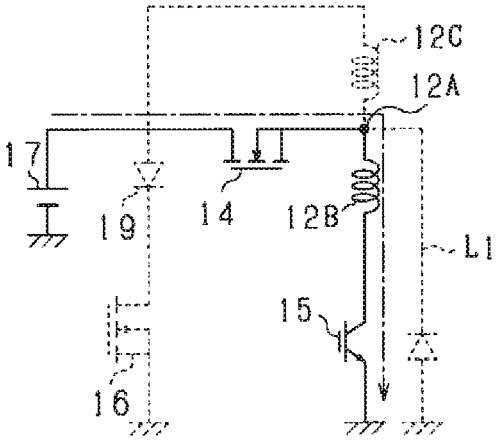
FIG. 2 is a diagram showing a flow of primary current when discharge start control is started.

The control contents of the discharge start control will be described. During the period in which the discharge start control is performed, the second switching element 16 is controlled to be always in an open state. Then, the third switching element 14 and the first switching element 15 are controlled to be in a closed state, whereby the primary current I1 flows from the power supply unit 17 to the first winding 12B, as shown in FIG. 2. After a lapse of a first predetermined time, the first switching element 15 is controlled to be in an open state. As a result, the conduction of the primary current I1 flowing from the power supply unit 17 to the first winding 12B is interrupted, a high voltage is induced in the secondary coil 13, and the gas in the spark gap unit of the ignition plug 20 undergoes dielectric breakdown, so that a spark discharge is generated in the ignition plug 20.

The case assumed herein is that the discharge start control described above is performed in the absence of the third diode 19. In this case, while the primary current I1 flows from the power supply unit 17 to the first winding 12B, a current flowing from the second switching element 16 to the power supply unit 17 via the second winding 12C may be generated. That is, a magnetic circuit is constituted from the first winding 12B and the second winding 12C, or leakage magnetic fluxes are interlinked, whereby when the first switching element 15 interrupts the primary current I1 flowing to the first winding 12B, a negative voltage may be generated in the second winding 12C, and a current may flow from the ground side to the power supply unit 17. If a current flowing from the second switching element 16 to the power supply unit 17 via the second winding 12C is generated, the generated current and the primary current I1 flowing from the power supply unit 17 to the first winding 12B are offset with each other, so that the primary current I1 is reduced by the offset amount. As a countermeasure for this, a third diode 19 is provided, a cathode side of which is connected to the second switching element 16, and an anode side of which is connected to an end of the second winding 12C on the second switching element 16 side. This makes it possible to suppress current flow from the second switching element 16 to the power supply unit 17 via the second winding 12C, and to prevent a decrease in the voltage generated by the discharge start control.

Figure 3:
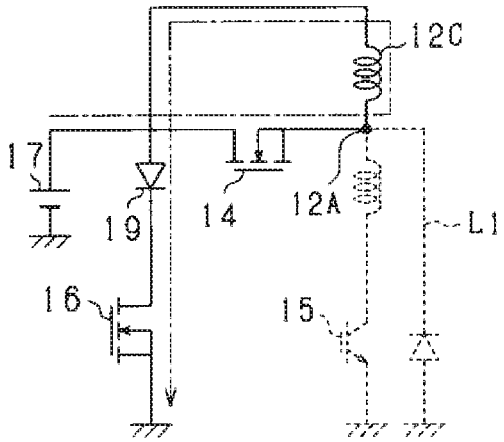
FIG. 3 is a diagram showing a flow of the primary current when discharge maintenance control is performed.

After the discharge start control is performed, discharge maintenance control is performed. During the period in which the discharge maintenance control is performed, the first switching element 15 is controlled to be always in an open state. In this state, the third switching element 14 and the second switching element 16 are controlled to be in closed states, whereby the primary current I1 flows from the power supply unit 17 to the second winding 12C, as shown in FIG. 3. Then, the third switching element 14 is controlled to be in an open state, thereby interrupting the conduction of the primary current I1 flowing from the power supply unit 17 to the second winding 12C.

Figure 4:
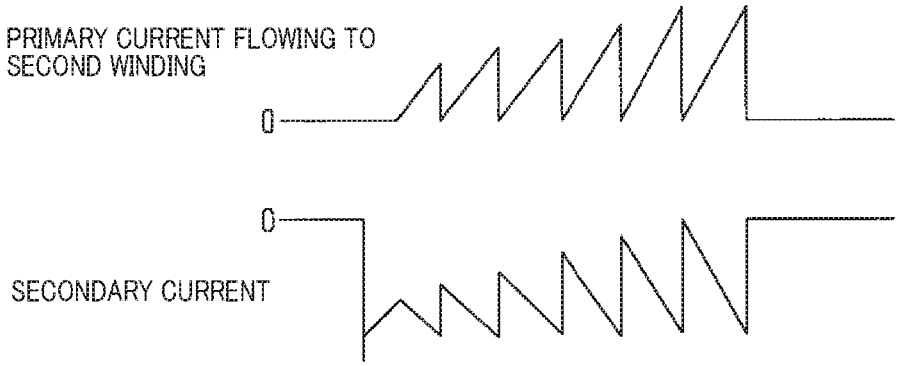
FIG. 4 is a diagram showing variations of the primary current and secondary current when discharge maintenance control is performed in an ignition system that is not provided with a current circulation path.

If the ignition system 10 is not provided with the current circulation path L1, when the conduction of the primary current I1 flowing to the second winding 12C is interrupted by controlling the third switching element 14 to be in an open state, the primary current I1 flowing to the second winding 12C is interrupted, and becomes 0 in steps. As a result, as shown in FIG. 4, every time the third switching element 14 is controlled to be in an open state, the absolute value of the secondary current I2 also rapidly decreases in steps. In accordance with that, there is a risk that, for example, the discharge spark is blown off by the air flow etc., and that the spark discharge generated in the ignition plug 20 cannot be maintained.

Figure 5:
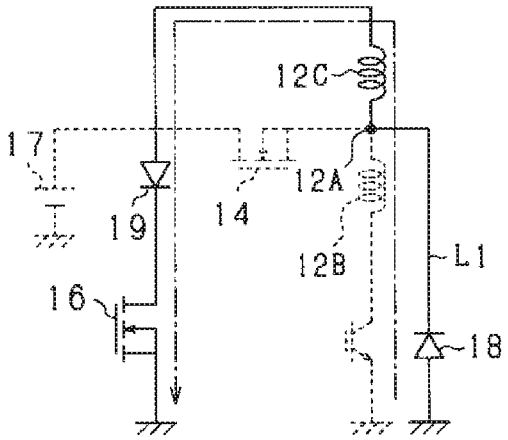
FIG. 5 is a diagram showing a flow of circulating primary current when the discharge maintenance control is performed.

In this respect, since the present ignition system 10 is provided with the current circulation path L1, when the third switching element 14 is controlled to be in an open state, the primary current I1 is circulated to the second winding 12C via the current circulation path L1 by the inductance of the second winding 12C, as shown in FIG. 5, even after interruption by the third switching element 14. Accordingly, the primary current I1 gradually decays, and the absolute value of the secondary current I2 flowing to the ignition plug 20 can be prevented from rapidly decreasing in steps.

In addition, since the current circulation path L1 is connected to the center tap 12A, the primary current I1 flowing through the current circulation path L1 does not flow to the first winding 12B, but directly flows to the second winding 12C, during the period in which the discharge maintenance control is performed. The influence of the first winding 12B is thereby eliminated, which makes it possible to control the primary current I1 accurately and responsively.

During the period in which the discharge maintenance control is performed, the primary current I1 repeatedly flows from the power supply unit 17 to the second winding 12C. However, depending on the setting of a turn ratio, which is a value obtained by dividing the number of turns of the secondary coil 13 by the number of turns of the second winding 12C, the voltage that needs to be applied to the second winding 12C may be higher than a predetermined voltage that can be applied by the power supply unit 17. In this case, the primary current I1 cannot flow from the power supply unit 17 to the second winding 12C. As a result, there is a concern that the spark discharge generated in the ignition plug 20 cannot be maintained.

As a countermeasure for this, in the present embodiment, the ignition coil 11 is configured so that the turn ratio mentioned above is larger than a voltage ratio as a value obtained by dividing a discharge maintenance voltage by the predetermined voltage applied by the power supply unit 17. The discharge maintenance voltage is a voltage when the spark discharge generated in the ignition plug 20 by discharge generation control is maintained.

The discharge maintenance voltage varies depending on the operating environment of the engine ECU. Since the spark discharge generated in the ignition plug 20 can be maintained within a range of 2 to 3 kV on average, the discharge maintenance voltage is set as a fixed value within a range of 2 to 3 kV. That is, since the voltage ratio is a fixed value, the smaller the number of turns of the second winding 12C, the larger the turn ratio. Accordingly, when the number of turns of the second winding 12C is reduced so that the turn ratio is larger than the voltage ratio, the voltage that needs to be applied to the second winding 12C can be set to be lower than the voltage that can be applied by the power supply unit 17 during the period in which the discharge maintenance control is performed. Accordingly, during the period in which the discharge maintenance control is performed, the primary current I1 can repeatedly flow from the power supply unit 17 to the second winding 12C, and each time the secondary current I2 flows to the ignition plug 20. As a result, the spark discharge generated in the ignition plug 20 can be maintained. Consequently, there is no need to provide the power supply unit 17 with a voltage booster circuit, such as a DC-DC converter, and the ignition system 10 can be simplified.

Figure 6:
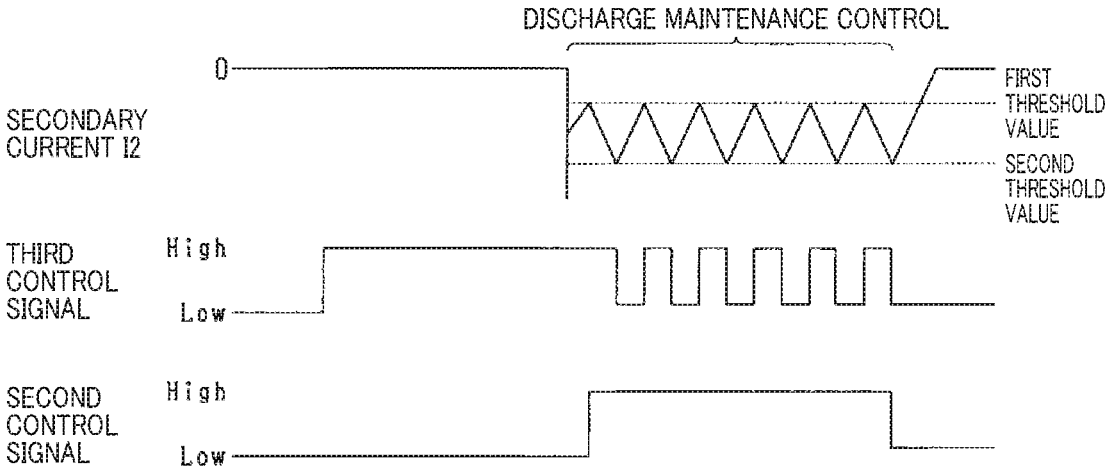
FIG. 6 is a diagram simply showing the details of controlling the secondary current within a desired range.

In the present embodiment, the ignition control circuit 30 sequentially detects the secondary current I2 flowing through the current detection path L2 during the period in which the discharge maintenance control is performed. Then, the control shown in FIG. 6 is performed based on the detected secondary current I2. In FIG. 6, the term "SECONDARY CURRENT I2" represents the value of the secondary current I2 flowing through the current detection path L2. The term "THIRD CONTROL SIGNAL" indicates, with high/low, whether a third control signal is output to the third control terminal 14G of the third switching element 14. Specifically, when a third control signal is output to the third control terminal 14G of the third switching element 14 (when "THIRD CONTROL SIGNAL" of FIG. 6 is high), the third switching element 14 is controlled to be in a closed state. Moreover, when a third control signal is not output to the third control terminal 14G of the third switching element 14 (when "THIRD CONTROL SIGNAL" of FIG. 6 is low), the third switching element 14 is controlled to be in an open state. The term "SECOND CONTROL SIGNAL" indicates, with high/low, whether a second control signal is output to the second control terminal 16G of the second switching element 16.

As shown in FIG. 6, when the absolute value of the secondary current I2 detected while discharge maintenance control is performed becomes smaller than a first threshold value, the third switching element 14 and the second switching element 16 are controlled to be in closed states. The primary current I1 can thereby flow from the power supply unit 17 to the second winding 12C. In accordance with that, the absolute value of the secondary current I2 flowing to the ignition plug 20 increases. When the absolute value of the detected secondary current I2 becomes larger than a second threshold value, which is set to be larger than the first threshold value, the third switching element 14 is controlled to be in an open state. The primary current I1 flowing from the power supply unit 17 to the second winding 12C is thereby interrupted, and the absolute value of the secondary current I2 flowing to the ignition plug 20 decreases. When the primary current I1 is interrupted by the third switching element 14, the primary current I1 of the second winding 12C flows while circulating through the current circulation path L1 and decreases, so that the secondary current I2 gradually decays. Thus, when the above control is performed, the secondary current I2 can gradually change, and can easily fall within the range from the first threshold value to the second threshold value. Further, since a rapid decrease in the secondary current I2 can be prevented, it is possible to perform discharge control capable of preventing blowout of the discharge spark.

Next, an aspect of the discharge control according to the present embodiment will be described with reference to FIG. 7.

Figure 7:
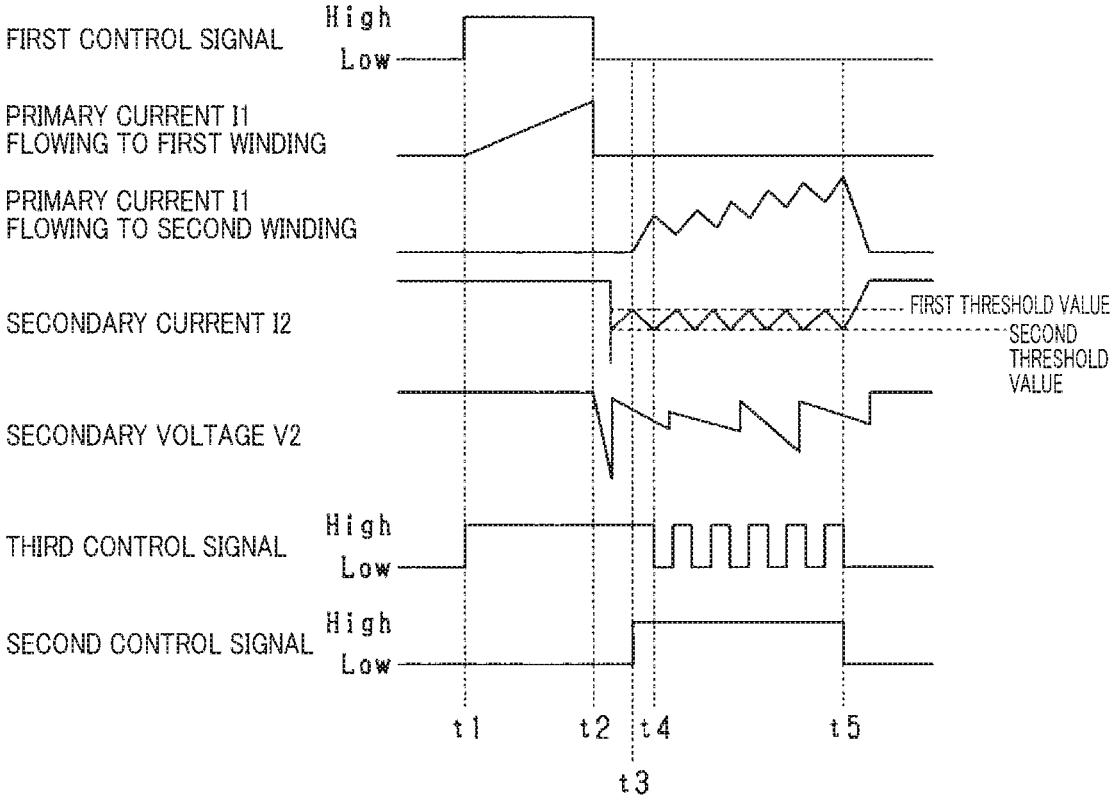
FIG. 7 is a timing diagram showing operation of discharge control according to the present embodiment.

In FIG. 7, the phrase "PRIMARY CURRENT I1. FLOWING TO FIRST WINDING" represents the primary current I1 flowing to the first winding 12B. Similarly, the phrase "PRIMARY CURRENT I1. FLOWING TO SECOND WINDING" represents the primary current I1 flowing to the second winding 12C. Further, the term "SECONDARY VOLTAGE V2" represents the value of the secondary voltage V2 applied to the ignition plug 20. The term "FIRST CONTROL SIGNAL" indicates, with high/low, whether a first control signal is output to the first control terminal 15G of the first switching element 15.

Discharge generation control is performed by the ignition control circuit 30 based on the ignition signal IGt output from the engine ECU. In the discharge generation control, a third control signal is transmitted to the third control terminal 14G of the third switching element 14, and a first control signal is transmitted to the first control terminal 15G of the first switching element 15 (see time t1). The third switching element 14 and the first switching element 15 are thereby controlled to be in closed states while the second switching element 16 is in an open state. As a result, the primary current I1 flows from the power supply unit 17 to the first winding 12B, and the primary current I1 flowing to the first winding 12B increases.

After the lapse of a first predetermined time, the output of the first control signal is stopped while maintaining the state in which the third control signal is transmitted to the third control terminal 14G of the third switching element 14 (see time t2). The first switching element 15 is thereby controlled to be in an open state, the primary current I1 flowing to the first winding 12B is interrupted, a high voltage is induced in the secondary coil 13, and a spark discharge is generated in the ignition plug 20.

Then, discharge maintenance control is performed by the ignition control circuit 30. In the discharge maintenance control, the secondary current I2 flowing through the current detection path L2 is sequentially detected by the ignition control circuit 30. When the absolute value of the detected secondary current I2 becomes smaller than the first threshold value, the primary current I1 is controlled to flow from the power supply unit 17 to the second winding 12C so that the spark discharge generated in the ignition plug 20 does not disappear. Since the third switching element 14 is controlled to be in a closed state and the second switching element 16 is controlled to be in an open state at time t3 of FIG. 7, a second control signal is transmitted to the second control terminal 16G of the second switching element 16. The second switching element 16 is thereby controlled to be in a closed state, the primary current I1 flows to the second winding 12C, and the secondary current I2 increases.

When the absolute value of the detected secondary current I2 becomes larger than the second threshold value, the output of the third control signal is stopped (see time t4). The third switching element 14 is thereby controlled to be in an open state, the primary current I1 flowing from the power supply unit 17 to the second winding 12C is interrupted, and the primary current I1 is circulated to the second winding 12C via the current circulation path L1. Subsequently, opening and closing operation of the third switching element 14 is controlled so that the absolute value of the secondary current I2 detected in the current detection path L2 is larger than the first threshold value and smaller than the second threshold value, whereby a spark discharge is continuously generated in the ignition plug 20 until the discharge period ends (see times t3 to t5).

FIG. 7 assumes an operational situation in which the flow rate in the combustion chamber changes from moment to moment. During the period in which the discharge maintenance control is performed, the secondary voltage V2 is not stable because the discharge spark length is extended or shortened by the air flow etc. (see times t3 to t5). However, on the other hand, the secondary current I2 can be stably controlled within the range from the first threshold value to the second threshold value. Thus, even in an operating state in which the secondary voltage V2 is not stable, the present ignition system 10 can suppress blowout of the spark discharge generated in the ignition plug 20, so that the spark discharge can be stably maintained.

Many of the components constituting the ignition system 10 are accommodated in a case 50 in which the ignition coil 11 is accommodated. The inner structure of the case 50 will be described using FIG. 8.

Figure 8:
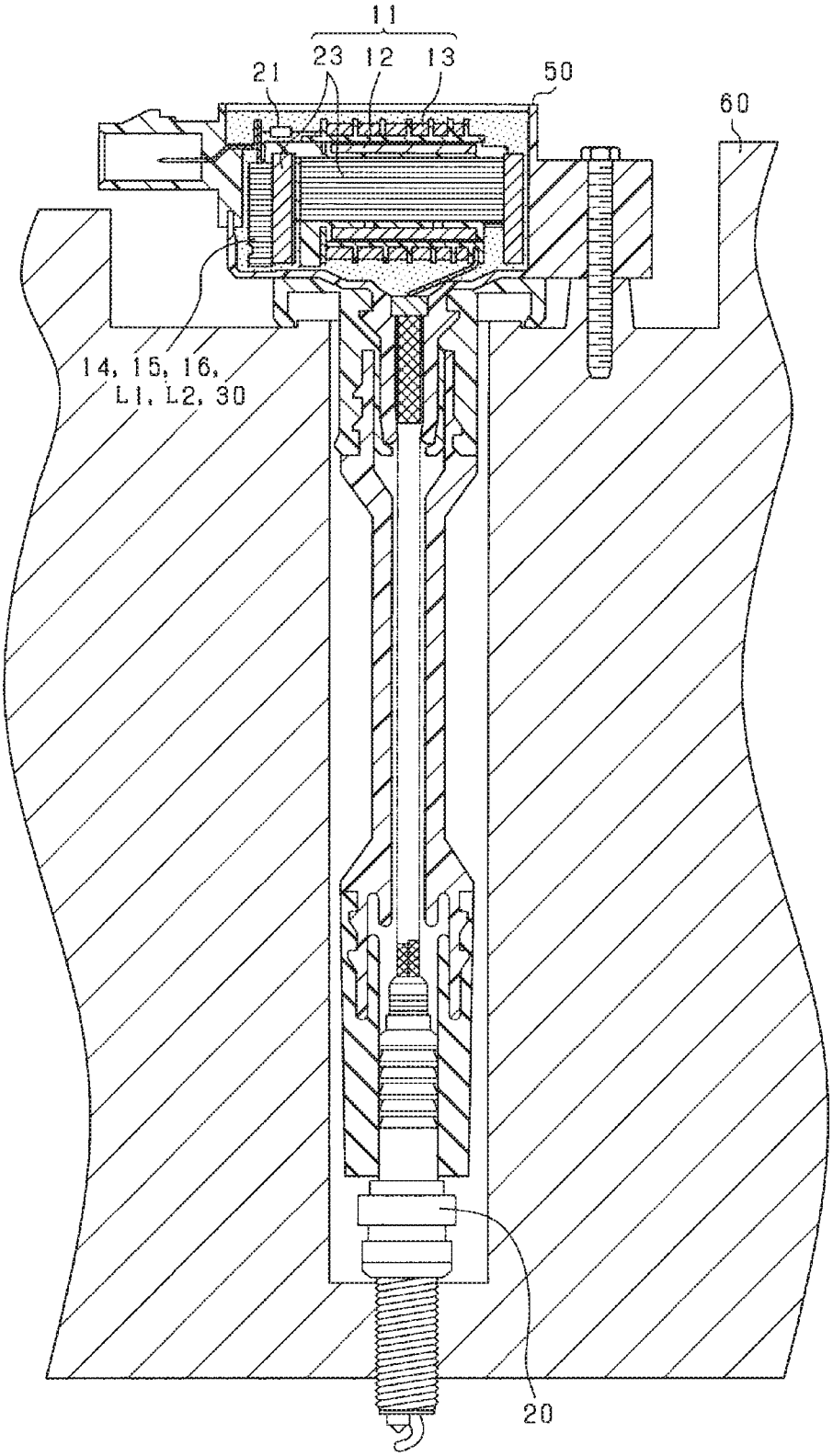
FIG. 8 is a schematic block diagram particularly showing the periphery of a case containing an ignition coil in an internal combustion engine.

FIG. 8 particularly shows the structure around the case 50. In the case 50, the ignition coil 11 is provided, and the primary coil 12, the secondary coil 13, and the vertically laminated iron core 23 are mounted from the inside to the outside. Further, a predetermined space is formed between the iron core 23 and the case 50, and the third switching element 14, the first switching element 15, the second switching element 16, the current circulation path L1, the current detection path L2, and the ignition control circuit 30 are provided in the predetermined space.

The protective diode 21 is provided between the secondary coil 13 and the case 50, and the anode side of the protective diode 21 is electrically connected to the first end of the secondary coil 13 by a wire. Further, the cathode side of the protective diode 21 is connected to the current detection path L2 provided in the predetermined space mentioned above.

As described above, the components constituting the ignition system 10, except for the power supply unit 17 and the ignition plug 20, can be accommodated in the case 50. Accordingly, the wiring can be reduced, and the enlargement of the ignition system 10 can be suppressed, so that vehicle mountability can be improved.

The first embodiment can also be carried out with the following modifications.

Figure 9:
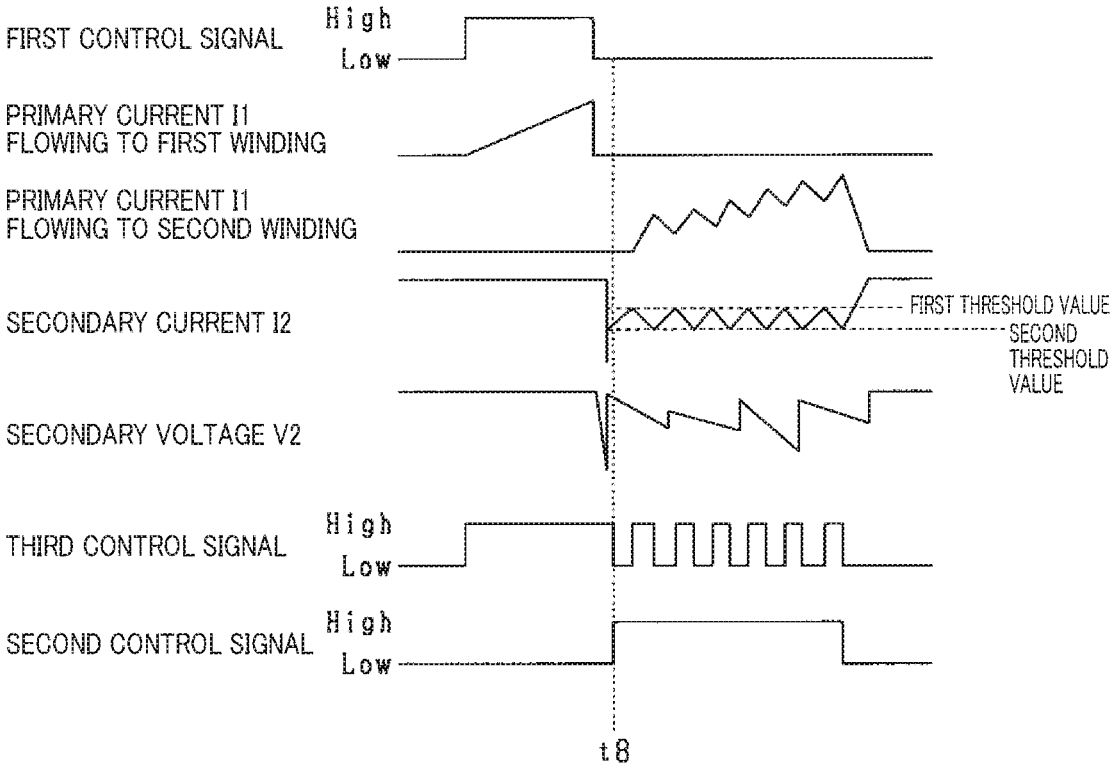
FIG. 9 is a timing diagram showing operation of discharge control according to another example.

The aspect of the discharge control according to the first embodiment has been described with reference to FIG. 7. In FIG. 7, after discharge generation control is performed by the ignition control circuit 30 based on the ignition signal IGt output from the engine ECU, a spark discharge is generated in the ignition plug 20, and until the absolute value of the secondary current I2 becomes smaller than the first threshold value (see times t1 to t3), the second switching element 16 is controlled to be in an open state, and the third switching element 14 is controlled to be in a closed state. This may be configured as shown in FIG. 9. Specifically, by controlling the first switching element 15 to be in an open state, a second control signal may be output, and the output of the third control signal may be stopped after a high voltage is induced in the secondary coil 13 until the absolute value of the secondary current I2 becomes smaller than the first threshold value (see time t8). This configuration also provides actions and effects according to the above embodiment.

In the first embodiment, during the period in which the discharge maintenance control is performed, the third switching element 14 is controlled to be in a closed state when the absolute value of the detected secondary current I2 becomes smaller than the first threshold value, and the third switching element 14 is controlled to be in an open state when the absolute value of the detected secondary current I2 becomes larger than the second threshold value. In this respect, opening and closing of the third switching element 14 may be controlled for a predetermined time, regardless of the value of the secondary current I2. For example, the open and closed state of the third switching element 14 may be switched every time a second predetermined time elapses during the period in which the discharge maintenance control is performed. In this case, it is not necessary to detect the secondary current I2 during the period in which the discharge maintenance control is performed; thus, it is not necessary to form the current detection path L2, and it is possible to reduce the cost of the ignition system 10.

In the first embodiment, the first switching element 15 is controlled to be always in an open state during the period in which the discharge maintenance control is performed. In this state, when the absolute value of the secondary current I2 is smaller than the first threshold value, the third switching element 14 and the second switching element 16 are controlled to be in closed states, and when the absolute value of the secondary current I2 becomes larger than the second threshold value, the third switching element 14 is controlled to be in an open state while the second switching element 16 is in a closed state, whereby the primary current I1 flowing from the power supply unit 17 to the second winding 12C is conducted and circulated. In place of the discharge maintenance control, the first switching element 15 is controlled to be always in an open state during the period in which the discharge maintenance control is performed. In this state, when the absolute value of the secondary current I2 is smaller than the first threshold value, the third switching element 14 and the second switching element 16 may be controlled to be in closed states, and when the absolute value of the secondary current I2 becomes larger than the second threshold value, the second switching element 16 may be controlled to be in an open state while the third switching element 14 is in a closed state, whereby the primary current I1 flowing from the power supply unit 17 to the second winding 12C may be conducted and interrupted. This can also result in the same effects as those of the first embodiment.

Figure 10:
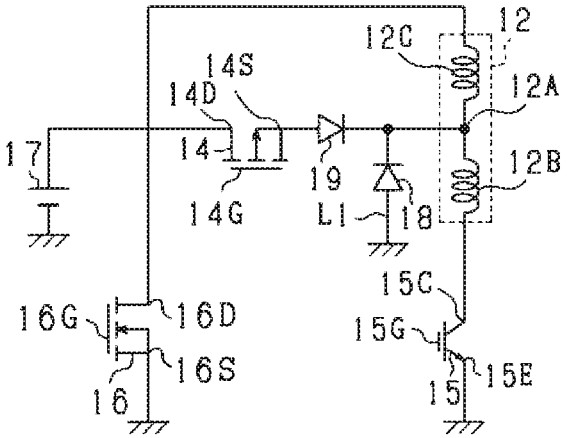
FIG. 10 is a diagram showing another example of the installation position of a third diode applied to the configuration of FIG. 1.

In the first embodiment, the third diode 19 is provided, a cathode side of which is connected to the second switching element 16, and an anode side of which is connected to an end of the second winding 12C on the second switching element 16 side. In this respect, as shown in FIG. 10, the third diode 19 may be configured so that its cathode side is connected to the center tap 12A, while its anode side is connected to the third ground side terminal 14S of the third switching element 14. The third diode 19 can thereby prevent current backflow if the power supply unit 17 is mistakenly assembled with reverse polarity. In the configuration according to this other example, the cathode side of the first diode 18 provided in the current circulation path L1 may be connected to a current path between the center tap 12A and the third diode 19, and the anode side of the first diode 18 may be grounded.

Figure 11:
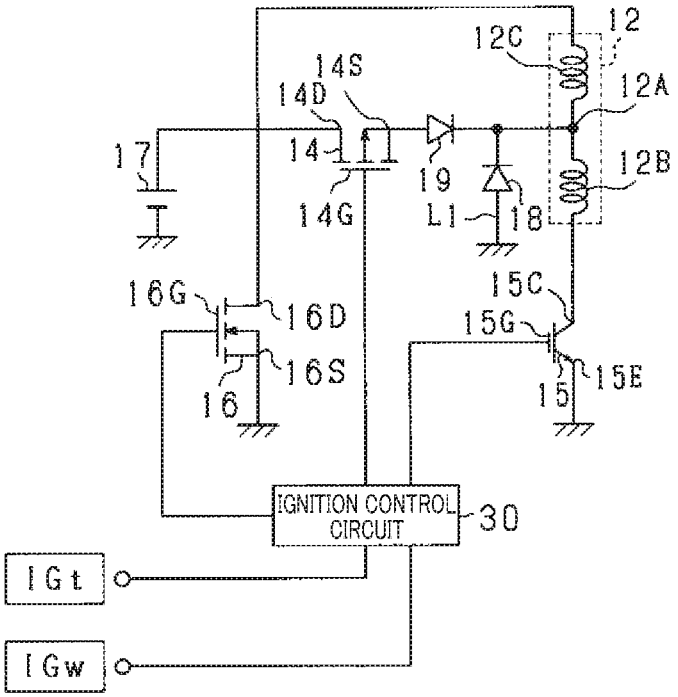
FIG. 11 is a schematic block diagram showing another example of the ignition system according to the first embodiment.

In this case, as shown in FIG. 11, the ignition control circuit 30 may be connected to an engine ECU (not shown) so as to receive an ignition signal IGt and an energy supply signal IGw output from the engine ECU. The ignition signal IGt (discharge start signal) sets the energization period of the first winding 12B in the discharge start control (discharge generation control). The energy supply signal IGw (current control signal) sets the command value of the secondary current I2 and the end timing of discharge maintenance control in the discharge maintenance control. Moreover, the ignition control circuit 30 is connected to the first control terminal 15G, the second control terminal 16G, and the third control terminal 14G so as to control opening and closing operation of the first switching element 15, the second switching element 16, and the third switching element 14, respectively. The third diode 19 and the third switching element 14 may be arranged in reverse.

Figure 12:
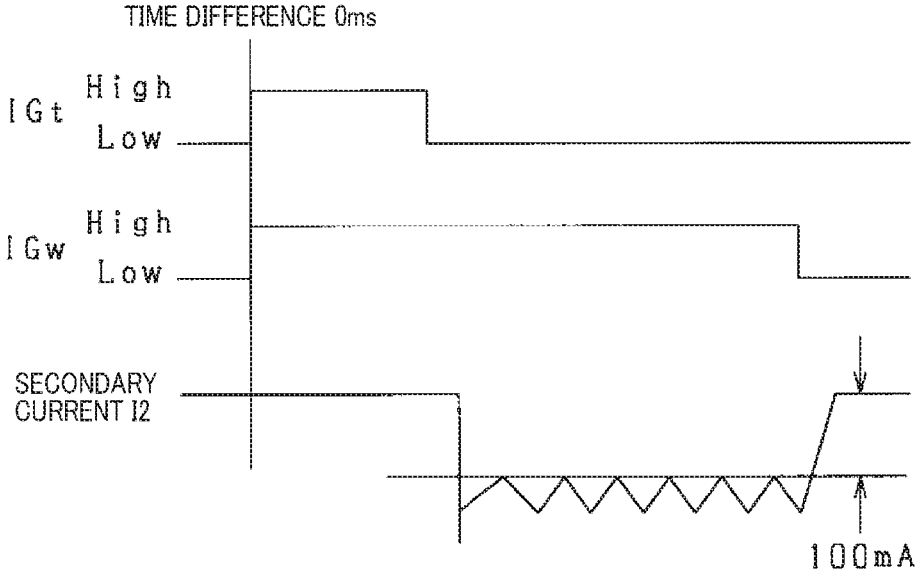
FIG. 12 is a diagram showing a setting of a command value of the secondary current based on an ignition signal and an energy supply signal.
Figure 13:
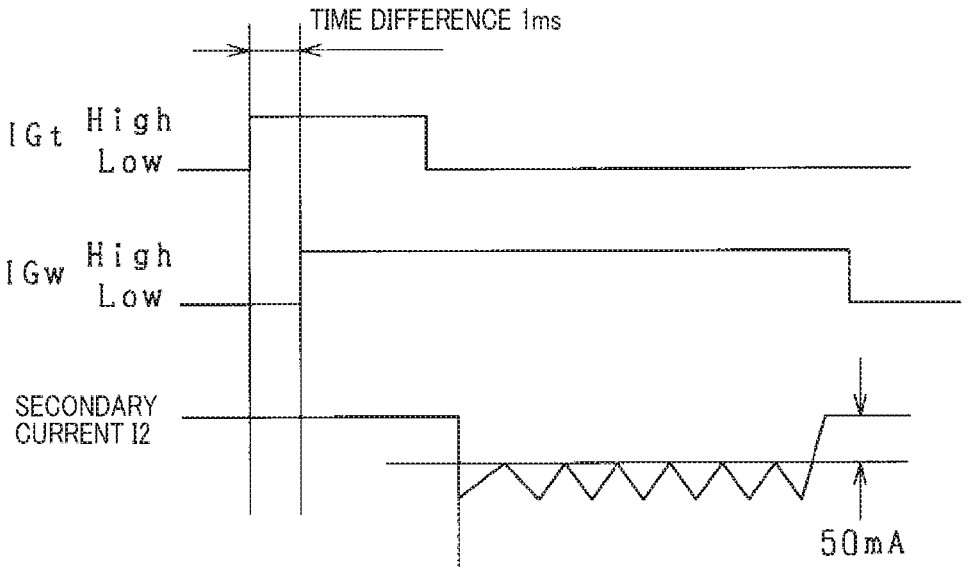
FIG. 13 is a diagram showing a setting of a command value of the secondary current based on an ignition signal and an energy supply signal.
Figure 14:
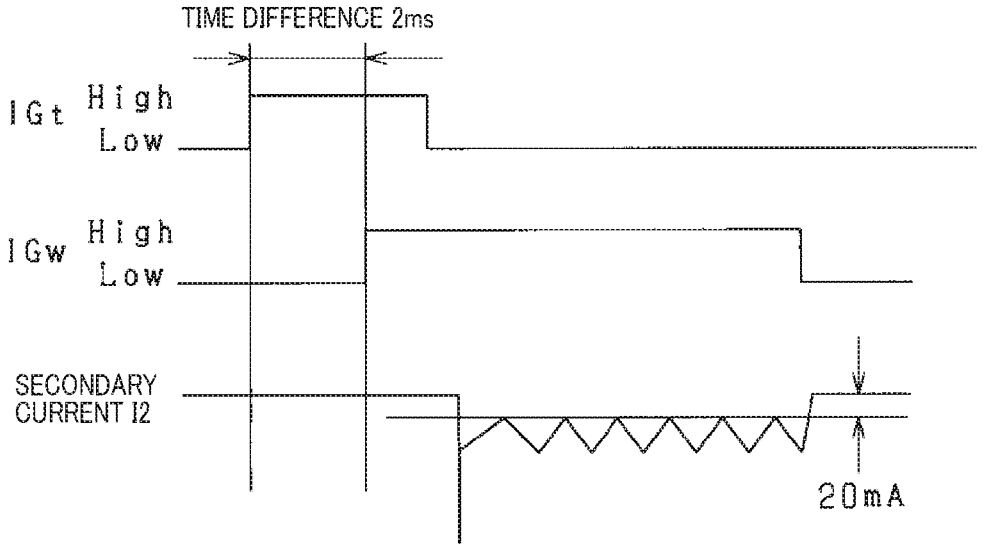
FIG. 14 is a diagram showing a setting of a command value of the secondary current based on an ignition signal and an energy supply signal.

For example, as shown in FIGS. 12 to 14, the energization period of the first winding 12B and the command value of the secondary current I2 in discharge maintenance control are set by the ignition signal IGt and the energy supply signal IGw. That is, the first winding 12B is energized while the ignition signal IGt is high. Further, a time difference is provided between the rising timing of the ignition signal IGt and the rising timing of the energy supply signal IGw, and the command value of the secondary current I2 is set based on the length of the time difference.

For example, when the time difference is 0 ms, the command value of the secondary current I2 is set to 100 ms; when the time difference is 1 ms, the command value of the secondary current I2 is set to 50 ms; and when the time difference is 2 ms, the command value of the secondary current I2 is set to 20 ms. Then, the command value of the secondary current I2 may be regarded as the first threshold value, and a value obtained by adding a predetermined value to the command value of the secondary current I2 may be regarded as the second threshold value. The combination of the time difference and the command value of the secondary current I2 can be changed in any way. Further, the end timing of discharge maintenance control is set according to the falling timing of the energy supply signal IGw. The setting of the energization period of the first winding 12B based on the ignition signal IGt, and the setting of the command value of the secondary current I2 and the end timing of discharge maintenance control based on the energy supply signal IGw can also be applied to other embodiments and their modifications.

Figure 15:
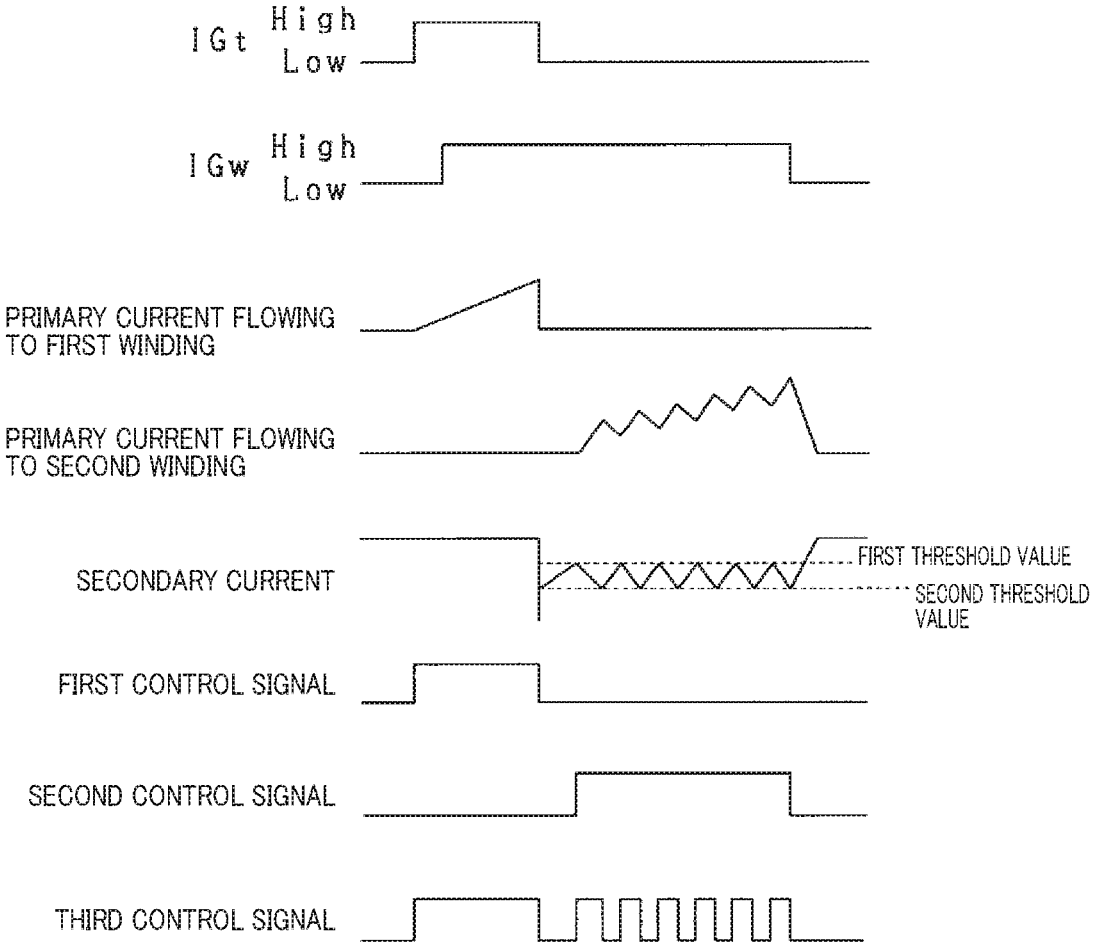
FIG. 15 is a timing diagram showing operation of discharge control according to the other example shown in FIG. 11.

As shown in FIG. 15, the second switching element 16 is controlled to be in an open state by the second control signal during the period in which the discharge start control is performed. Then, when the ignition signal IGt rises, the first switching element 15 and the third switching element 14 are controlled to be in closed states by the first control signal and the third control signal, respectively, and the primary current I1 flows from the power supply unit 17 to the first winding 12B. Then, when the ignition signal IGt falls, the first switching element 15 and the third switching element 14 are controlled to be in open states by the first control signal and the third control signal, respectively. The conduction of the primary current I1 flowing from the power supply unit 17 to the first winding 12B is thereby interrupted, a high voltage is induced in the secondary coil 13, and the gas in the spark gap unit of the ignition plug 20 undergoes dielectric breakdown, so that a spark discharge is generated in the ignition plug 20.

After the discharge start control is performed, discharge maintenance control is performed. During the period in which the discharge maintenance control is performed, the first switching element 15 is controlled to be in an open state by the first control signal. In this state, the second switching element 16 and the third switching element 14 are controlled to be in closed states by the second control signal and the third control signal, respectively, whereby the primary current I1 flows from the power supply unit 17 to the second winding 12C. When the absolute value of the secondary current I2 becomes larger than the second threshold value, the third switching element 14 is controlled to be in an open state by the third control signal, whereby the conduction of the primary current I1 flowing from the power supply unit 17 to the second winding 12C is interrupted. The primary current I1 is thereby circulated to the second winding 12C via the current circulation path L1, the current of the second winding 12C gradually decays, and the secondary current I2 also decreases. When the absolute value of the secondary current I2 becomes smaller than the first threshold value, the third switching element 14 is controlled to be in a closed state again by the third control signal.

Figure 16:
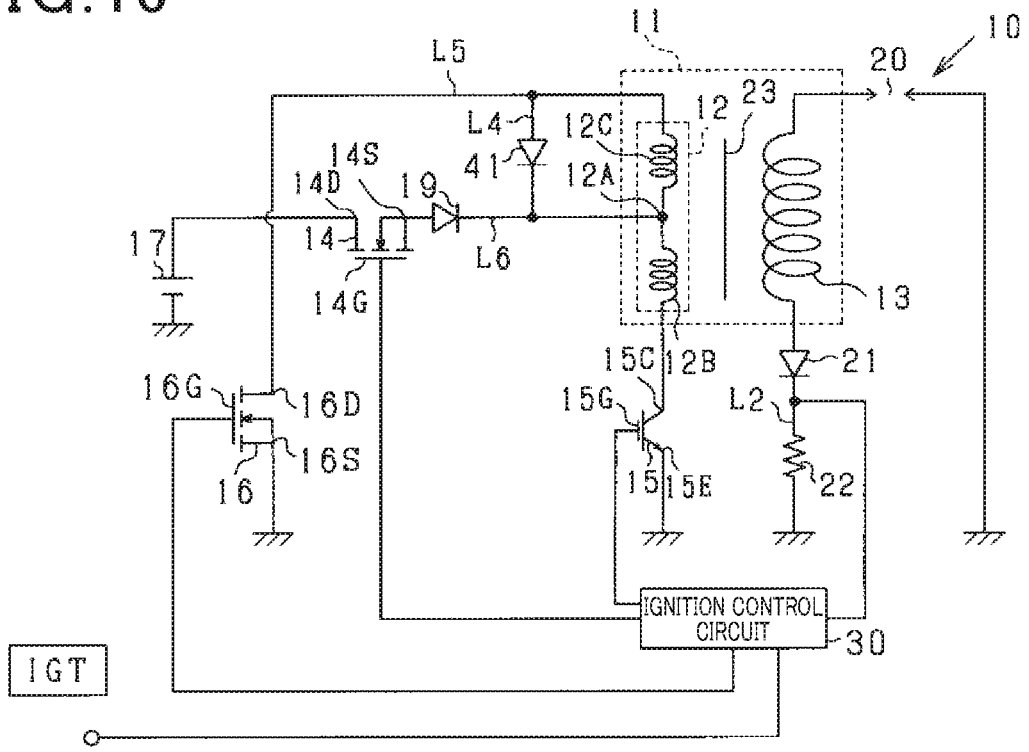
FIG. 16 is a schematic block diagram showing another example of the ignition system according to the first embodiment.

Alternatively, as shown in FIG. 16, a current circulation path L4 may be provided in place of the current circulation path L1. The current circulation path L4 includes a second diode 41. The cathode side of the second diode 41 is connected to a current path L5 between the second winding 12C and the second switching element 16, and the anode side of the second diode 41 is connected to a current path L6 between the third diode 19 and the center tap 12A.

Figure 17:
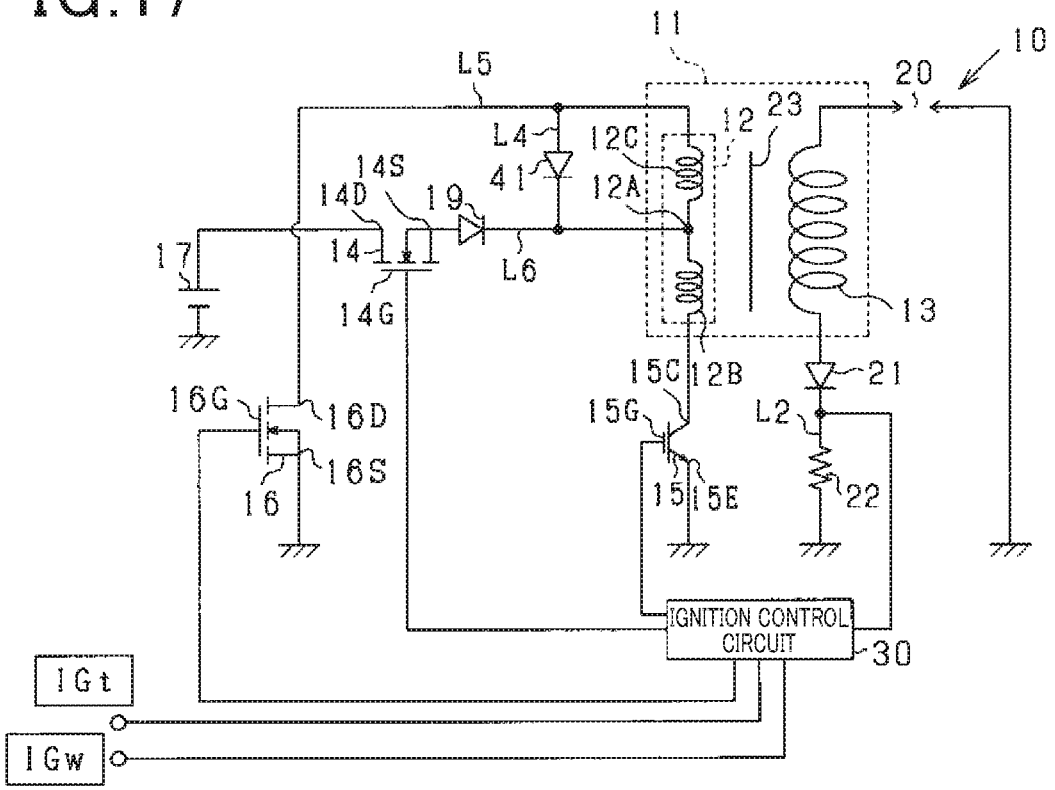
FIG. 17 is a schematic block diagram showing another example of the ignition system according to the first embodiment.

In this case, as shown in FIG. 17, the ignition control circuit 30 may be connected to an engine ECU (not shown) so as to receive an ignition signal IGt and an energy supply signal IGw output from the engine ECU. Then, the ignition control circuit 30 sets the energization period of the first winding 12B based on the ignition signal IGt, and sets the command value of the secondary current I2 and the end timing of discharge maintenance control based on the energy supply signal IGw.

Figure 18:
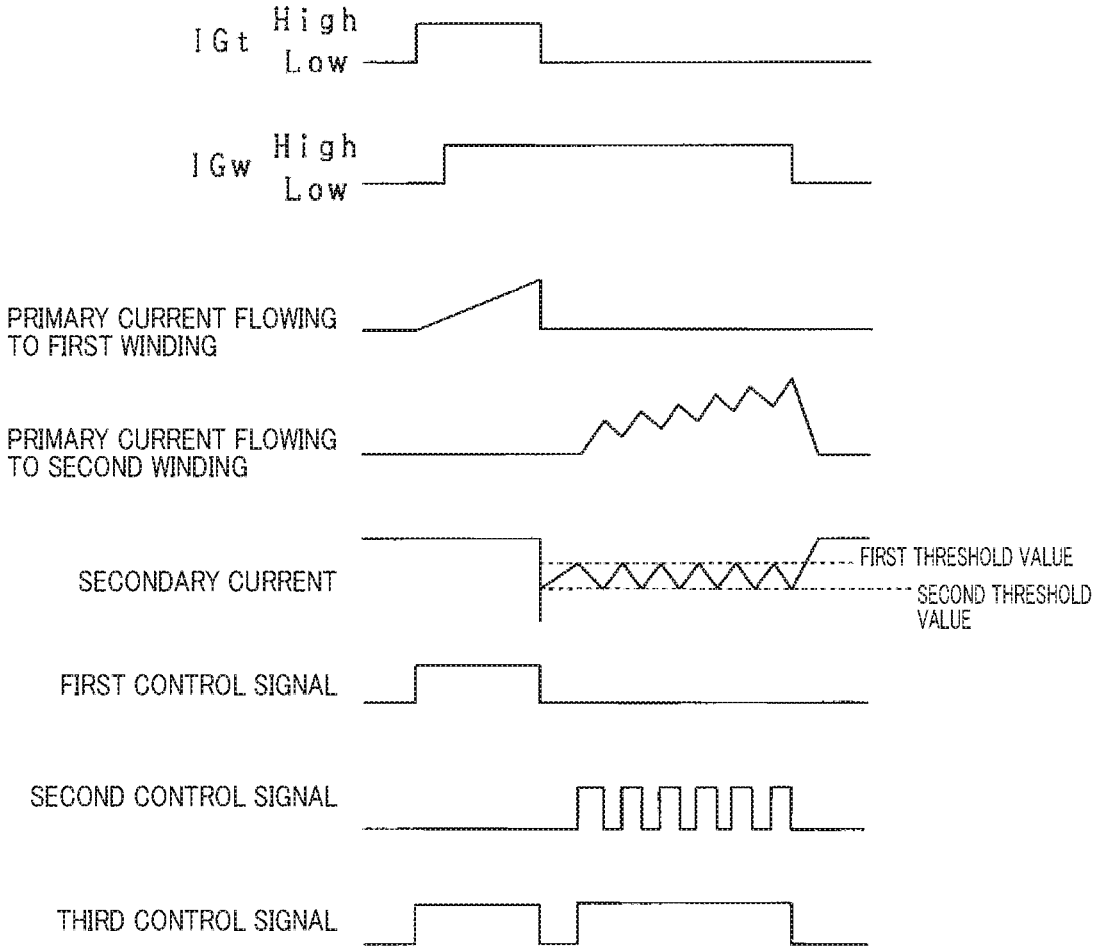
FIG. 18 is a timing diagram showing operation of discharge control according to the other example shown in FIG. 17.

As shown in FIG. 18, the aspect of discharge start control is the same as that of FIG. 15. After the discharge start control is performed, discharge maintenance control is performed.

During the period in which the discharge maintenance control is performed, the first switching element 15 is controlled to be in an open state by the first control signal. In this state, the second switching element 16 and the third switching element 14 are controlled to be in closed states by the second control signal and the third control signal, respectively, whereby the primary current I1 flows from the power supply unit 17 to the second winding 12C. When the absolute value of the secondary current I2 becomes larger than the second threshold value, the second switching element 16 is controlled to be in an open state by the second control signal, whereby the conduction of the primary current I1 flowing from the power supply unit 17 to the second winding 12C is interrupted. The primary current I1 is thereby circulated to the second winding 12C via the current circulation path L4, the current of the second winding 12C gradually decays, and the secondary current I2 also decreases. When the absolute value of the secondary current I2 becomes smaller than the first threshold value, the second switching element 16 is controlled to be in a closed state again by the second control signal.

Figure 19:
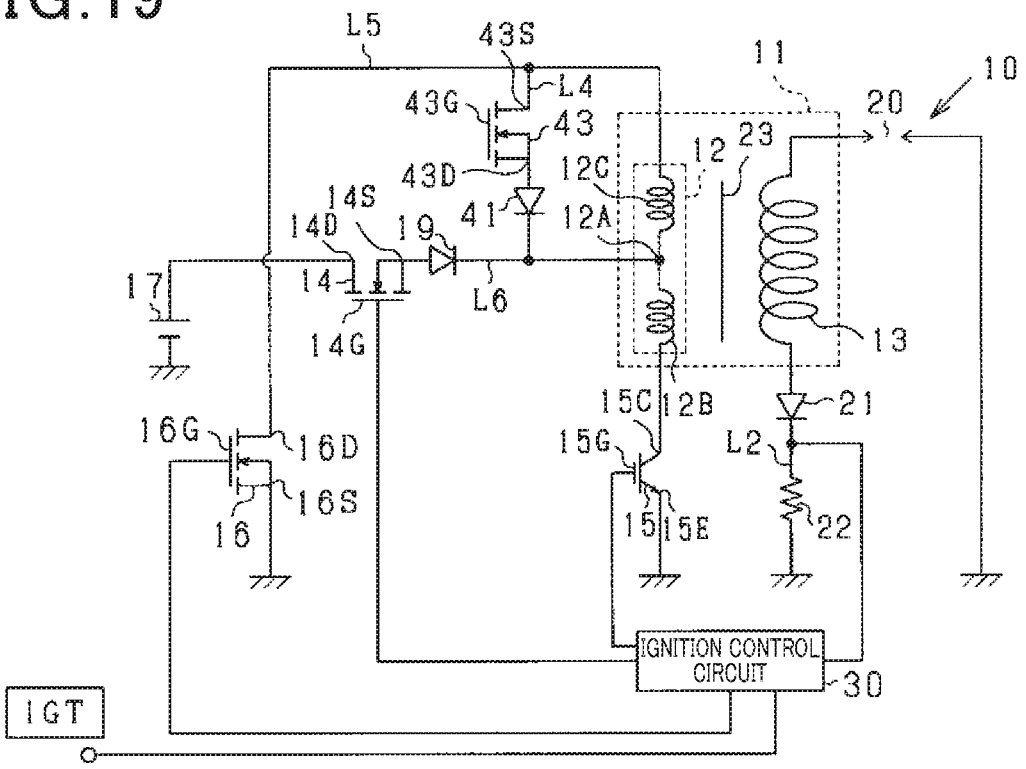
FIG. 19 is a schematic block diagram showing another example of the ignition system according to the first embodiment.

The configuration of FIG. 16 is provided with the current circulation path L4 including the second diode 41. In this respect, as shown in FIG. 19, the current circulation path L4 may be provided with a fourth switching element 43 on the anode side of the second diode 41. The fourth switching element 43 is a semiconductor switching element, and has a fourth control terminal 43G, a fourth power supply side terminal 43D, and a fourth ground side terminal 43S. The fourth switching element 43 is configured to control on/off states of energization between the fourth power supply side terminal 43D and the fourth ground side terminal 43S based on the fourth control signal input to the fourth control terminal 43G. In the fourth switching element 43, the fourth power supply side terminal 43D is connected to the second diode 41, and the fourth ground side terminal 43S is connected to the current path L5.

The aspect of discharge start control in the configuration of FIG. 19 will be described.

The second switching element 16 and the fourth switching element 43 are controlled to be always in open states during the period in which the discharge start control is performed. Then, the third switching element 14 and the first switching element 15 are controlled to be in closed states, whereby the primary current I1 flows from the power supply unit 17 to the first winding 12B. After the elapse of a first predetermined time, the first switching element 15 is controlled to be in an open state. The conduction of the primary current I1 flowing from the power supply unit 17 to the first winding 12B is thereby interrupted, a high voltage is induced in the secondary coil 13, and the gas in the spark gap unit of the ignition plug 20 undergoes dielectric breakdown, so that a spark discharge is generated in the ignition plug 20.

The aspect of discharge maintenance control in the configuration of FIG. 19 will be described.

After the discharge start control is performed, discharge maintenance control is performed. During the period in which the discharge maintenance control is performed, the first switching element 15 is controlled to be always in an open state. In this state, the third switching element 14, the second switching element 16, and the fourth switching element 43 are controlled to be in closed states, whereby the primary current I1 flows from the power supply unit 17 to the second winding 12C. When the absolute value of the secondary current I2 becomes larger than the second threshold value, the second switching element 16 is controlled to be in an open state, whereby the conduction of the primary current I1 flowing from the power supply unit 17 to the second winding 12C is interrupted. The primary current I2 is thereby circulated to the first winding 12C via the current circulation path L4, the current of the second winding 12C gradually decays, and the secondary current I2 also decreases. When the absolute value of the secondary current I2 becomes smaller than the first threshold value, the second switching element 16 is controlled to be in a closed state again.

As shown in FIG. 19, when the fourth switching element 43 is provided in the current circulation path L4, the circulating current flows at a voltage generated by interlinking magnetic fluxes from the first winding 12B to the second winding 12C during discharge formation, and a decrease in the secondary voltage V2 can be suppressed.

Second Embodiment

The following describes the second embodiment focusing on differences from the first embodiment.

Figure 20:
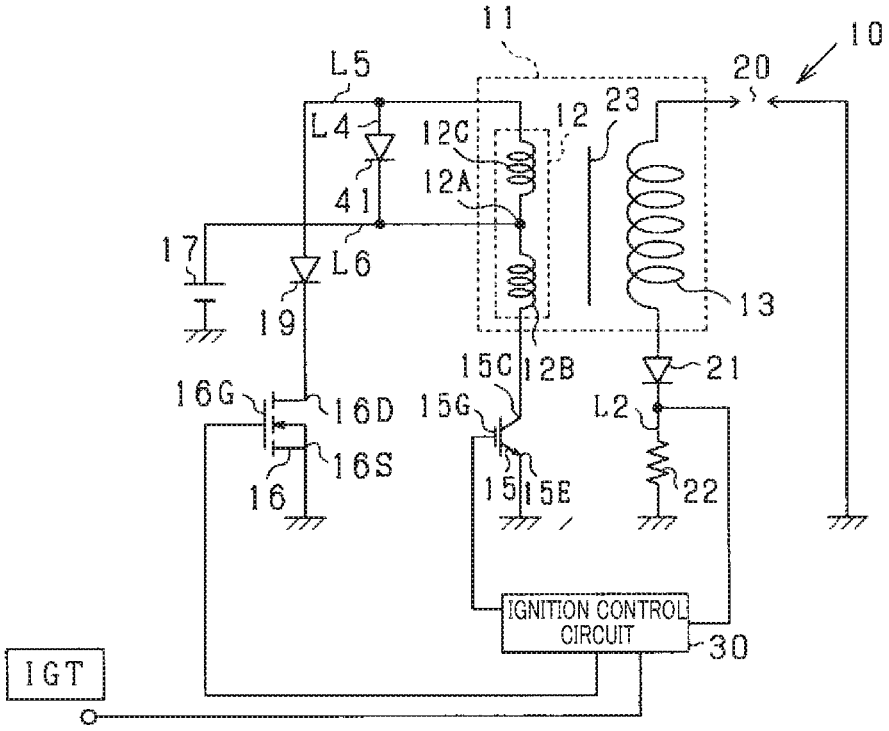
FIG. 20 is a schematic block diagram of an ignition system according to a second embodiment.

In the first embodiment, the center tap 12A is connected to the power supply unit 17 via the third switching element 14. In this respect, as shown in FIG. 20, the center tap 12A is directly connected to the power supply unit 17 by removing the third switching element 14. Further, the ignition system 10 according to the second embodiment includes a current circulation path L4 in place of the current circulation path L1. The current circulation path L4 includes a second diode 41. The cathode side of the second diode 41 is connected to a current path L5 between the second winding 12C and the third diode 19, and the anode side of the second diode 41 is connected to a current path L6 between the power supply unit 17 and the center tap 12A.

As in the first embodiment, the cathode side of the third diode 19 according to the second embodiment is connected to the second switching element 16, and the anode side is connected to an end of the second winding 12C on the second switching element 16 side. This makes it possible to suppress current flow from the second switching element 16 to the power supply unit 17 via the second winding 12C during discharge start control, and to prevent a decrease in the voltage generated by discharge start control.

Figure 21:
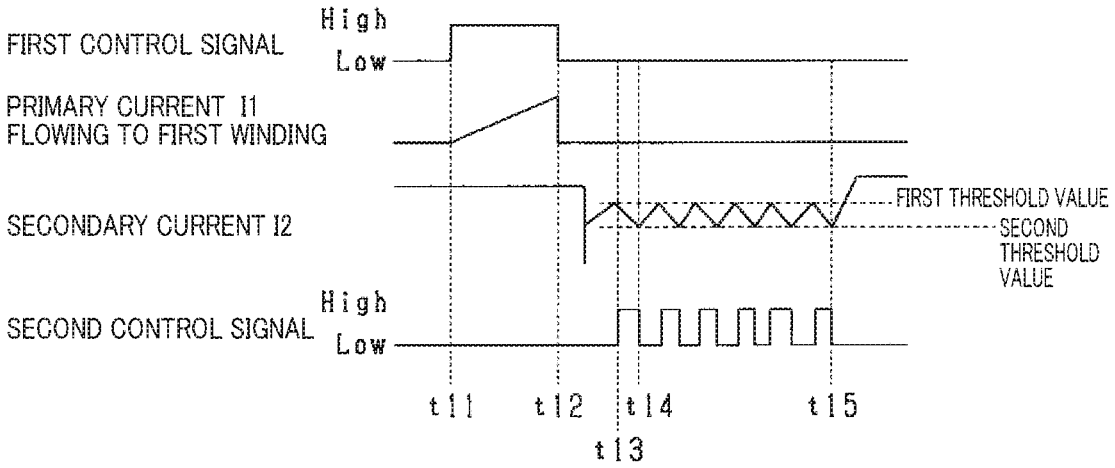
FIG. 21 is a timing diagram showing operation of discharge control according to the second embodiment.

With the above configuration, discharge control can be simplified because it is not necessary to provide the third switching element 14. In addition, the cost of the ignition system 10 can be reduced. An aspect of the discharge control according to the second embodiment will be described below with reference to FIGS. 20 and 21.

Discharge generation control is performed by the ignition control circuit 30 based on an ignition signal IGt output from the engine ECU. In the discharge generation control, a first control signal is transmitted to the first control terminal 15G of the first switching element 15 (see time t11). The first switching element 15 is thereby controlled to be in a closed state while the second switching element 16 is in an open state. As a result, the primary current I1 flows from the power supply unit 17 to the first winding 12B, and the primary current I1 flowing through the first winding 12B increases.

After the elapse of a first predetermined time, the output of the first control signal is stopped (see time t12). The first switching element 15 is thereby controlled to be in an open state, the conduction of the primary current I1 flowing to the first winding 12B is interrupted, a high voltage is induced in the secondary coil 13, and a spark discharge is generated in the ignition plug 20.

Then, discharge maintenance control is performed by the ignition control circuit 30. In the discharge maintenance control, the secondary current I2 flowing through the current detection path L2 is sequentially detected by the ignition control circuit 30. When the absolute value of the detected secondary current I2 becomes smaller than the first threshold value, a second control signal is transmitted to the second control terminal 16G of the second switching element 16 (see time t13). The second switching element 16 is thereby controlled to be in a closed state, and the primary current I1 flows from the power supply unit 17 to the second winding 12C.

When the absolute value of the detected secondary current I2 becomes larger than the second threshold value, the output of the second control signal is stopped (see time t14). The second switching element 16 is thereby controlled to be in an open state, and the primary current I1 flowing from the power supply unit 17 to the second winding 12C is interrupted. The primary current I1 is circulated to the second winding 12C via the current circulation path L4, the current of the second winding 12C gradually decays, and the secondary current I2 also decreases. When the absolute value of the secondary current I2 becomes smaller than the first threshold value, the second switching element 16 is controlled to be in a closed state again. Thus, during a period of discharge maintenance control, opening and closing operation of the second switching element 16 is controlled so that the absolute value of the secondary current I2 detected in the current detection path L2 is larger than the first threshold value and smaller than the second threshold value, whereby the ignition plug 20 continues to generate a spark discharge until the discharge period ends (see times t13 to t15).

Thus, the primary current I1 flowing to the first winding 12B can be conducted and interrupted by controlling the second switching element 16 to be in an open state, and then switching the first switching element 15. Further, the primary current I1 flowing to the second winding 12C can be conducted and circulated by controlling the first switching element 15 to be in an open state, and then switching the second switching element 16.

Moreover, because the current circulation path L4 is provided, the primary current I1 flowing through the current circulation path L4 does not flow to the first winding 12B, but flows to the second winding 12C, during a period of discharge maintenance control. Thus, it is possible to control the primary current I1 with high accuracy, without being influenced by the winding 12B. Consequently, the controllability of the secondary current I2 can be enhanced. As a result, it is possible to provide an ignition device that is resistant to accidental ignition.

Many components constituting the ignition system 10 are accommodated in a case 50 in which the ignition coil 11 is accommodated. In the second embodiment, a predetermined space is also formed between the iron core 23 and the case 50. The first switching element 15, the second switching element 16, the current circulation path L7, the current detection path L2, and the ignition control circuit 30 are provided in the predetermined space.

That is, the present internal combustion engine ignition system can be accommodated in a space in which the ignition coil 11 of the ignition plug 20 is accommodated. Accordingly, the wiring can be reduced, and the enlargement of the internal combustion engine ignition system can be suppressed, so that vehicle mountability can be improved.

The second embodiment can also be carried out with the following modifications.

Figure 22:
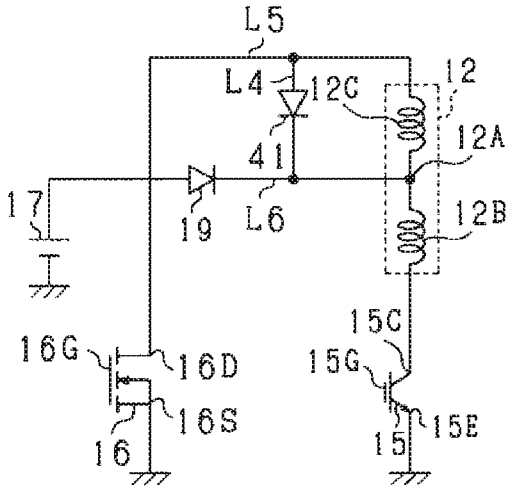
FIG. 22 is a diagram showing another example of the installation position of a third diode applied to the configuration of the second embodiment.

As another example applied to the second embodiment, the third diode 19 may be configured so that its cathode side is connected to the center tap 12A, while its anode side is connected to the power supply unit 17, as shown in FIG. 22. This makes it possible to prevent backflow if the power supply unit 17 is mistakenly assembled with reverse polarity.

In the second embodiment, during the period in which the discharge maintenance control is performed, the second switching element 16 is controlled to be in a closed state when the absolute value of the detected secondary current I2 becomes smaller than the first threshold value, and the second switching element 16 is controlled to be in an open state when the detected absolute value of the secondary current I2 becomes larger than the second threshold value. In this respect, opening and closing of the second switching element 16 may be controlled for a predetermined time, regardless of the value of the secondary current I2. For example, during the period in which the discharge maintenance control is performed, the open and closed state of the second switching element 16 may be switched every time a second predetermined time elapses. In this case, it is not necessary to detect the secondary current I2 during the period in which the discharge maintenance control is performed. Thus, it is not necessary to form the current detection path L2, thereby making it possible to reduce the size and cost of the ignition system 10.

Figure 23:
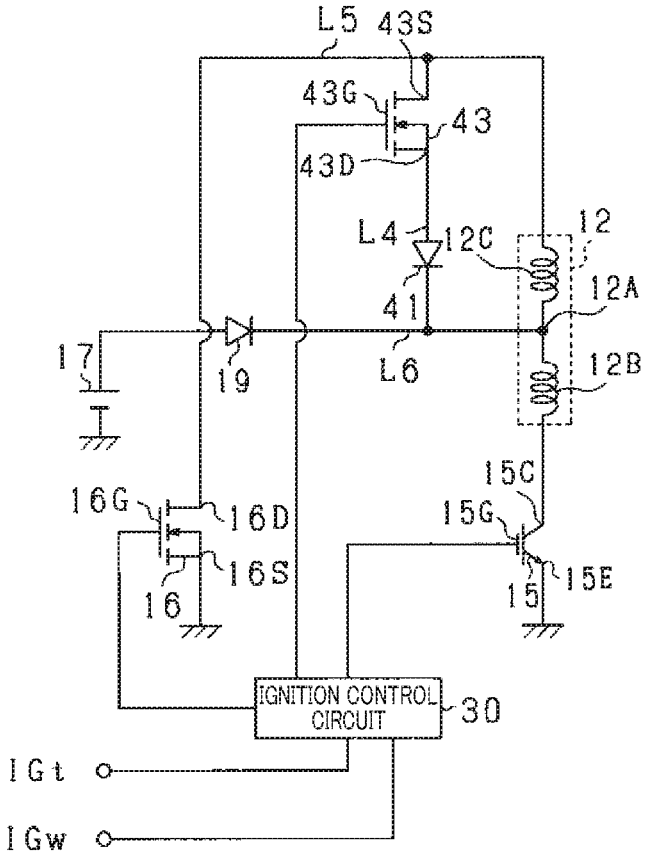
FIG. 23 is a schematic block diagram showing another example of the ignition system according to the second embodiment.

In the second embodiment, the second diode 41 is provided in the current circulation path L4. In this respect, the same configuration as that of the current circulation path L4 shown in FIG. 19 may be applied. Specifically, in the second embodiment, a fourth switching element 43 may also be provided on the anode side of the second diode 41 in the current circulation path L4, as shown in FIG. 23. In this case, actions and effects according to the other example shown in FIG. 19 can be provided.

In this case, as shown in FIG. 23, the ignition control circuit 30 may be connected to an engine ECU (not shown) so as to receive an ignition signal IGt and an energy supply signal IGw output from the engine ECU. The ignition control circuit 30 sets the energization period of the first winding 12B based on the ignition signal IGt, and sets the command value of the secondary current I2 and the end timing of discharge maintenance control based on the energy supply signal IGw. Further, the ignition control circuit 30 is connected to the first control terminal 15G, the second control terminal 16G, and the fourth control terminal 43G so as to control opening and closing operation of the first switching element 15, the second switching element 16, and the fourth switching element 43, respectively. The second diode 41 and the fourth switching element 43 may be arranged in reverse.

Figure 24:
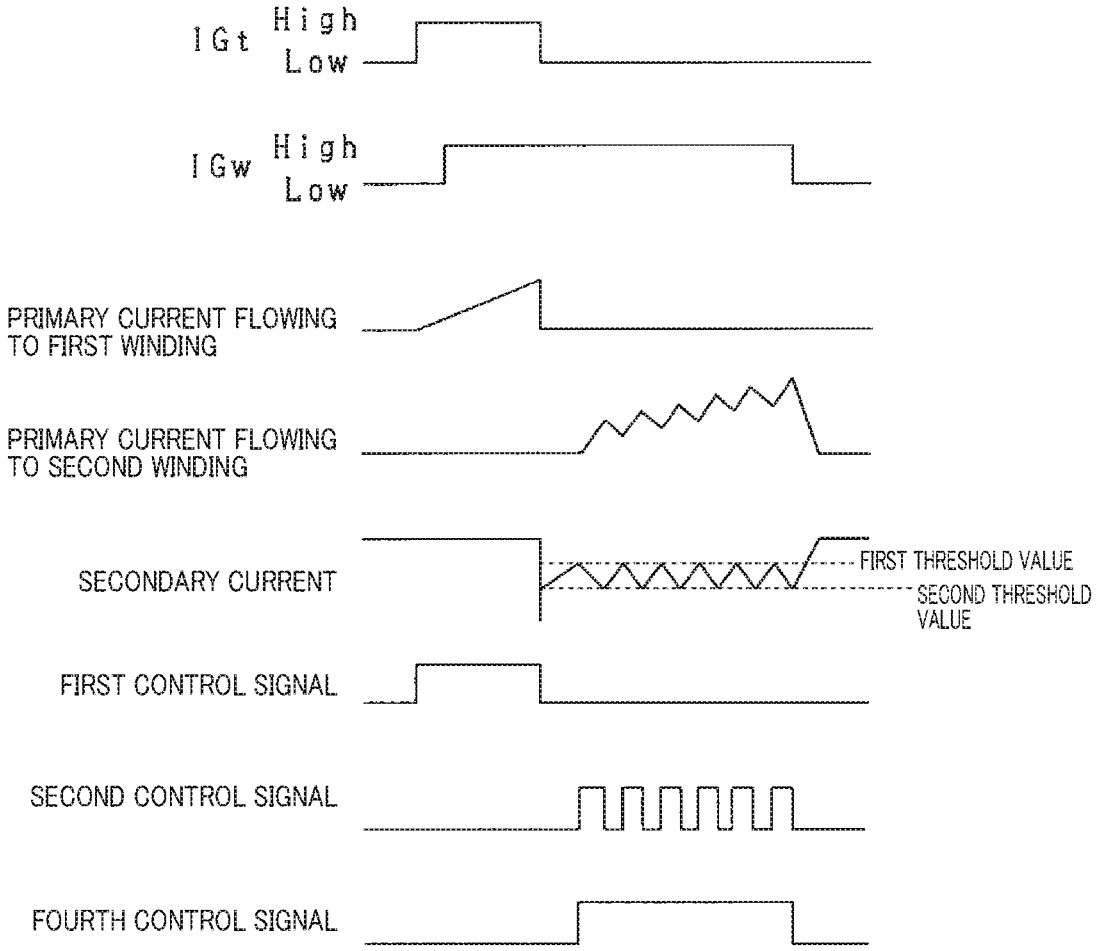
FIG. 24 is a timing diagram showing operation of discharge control according to the other example shown in FIG. 23.

As shown in FIG. 24, during the period in which the discharge start control is performed, the second switching element 16 and the fourth switching element 43 are controlled to be in an open state by the second control signal and the fourth control signal, respectively. Then, when the ignition signal IGt rises, the first switching element 15 is controlled to be in a closed state by the first control signal, and the primary current I1 flows from the power supply unit 17 to the first winding 12B. When the ignition signal IGt falls, the first switching element 15 is controlled to be in an open state by the first control signal. The conduction of the primary current I1 flowing from the power supply unit 17 to the first winding 12B is thereby interrupted, a high voltage is induced in the secondary coil 13, and the gas in the spark gap unit of the ignition plug 20 undergoes dielectric breakdown, so that a spark discharge is generated in the ignition plug 20.

After the discharge start control is performed, discharge maintenance control is performed. During the period in which the discharge maintenance control is performed, the first switching element 15 is controlled to be in an open state by the first control signal. In this state, the second switching element 16 and the fourth switching element 43 are controlled to be in closed states by the second control signal and the fourth control signal, respectively, whereby the primary current I1 flows from the power supply unit 17 to the second winding 12C. When the absolute value of the secondary current I2 becomes larger than the second threshold value, the second switching element 16 is controlled to be in an open state by the second control signal, whereby the conduction of the primary current I1 flowing from the power supply unit 17 to the second winding 12C is interrupted. The primary current I1 is thereby circulated to the second winding 12C via the current circulation path L4, the current of the second winding 12C gradually decays, and the secondary current I2 also decreases. When the absolute value of the secondary current I2 becomes smaller than the first threshold value, the second switching element 16 is controlled to be in a closed state again by the second control signal.

Figure 25:
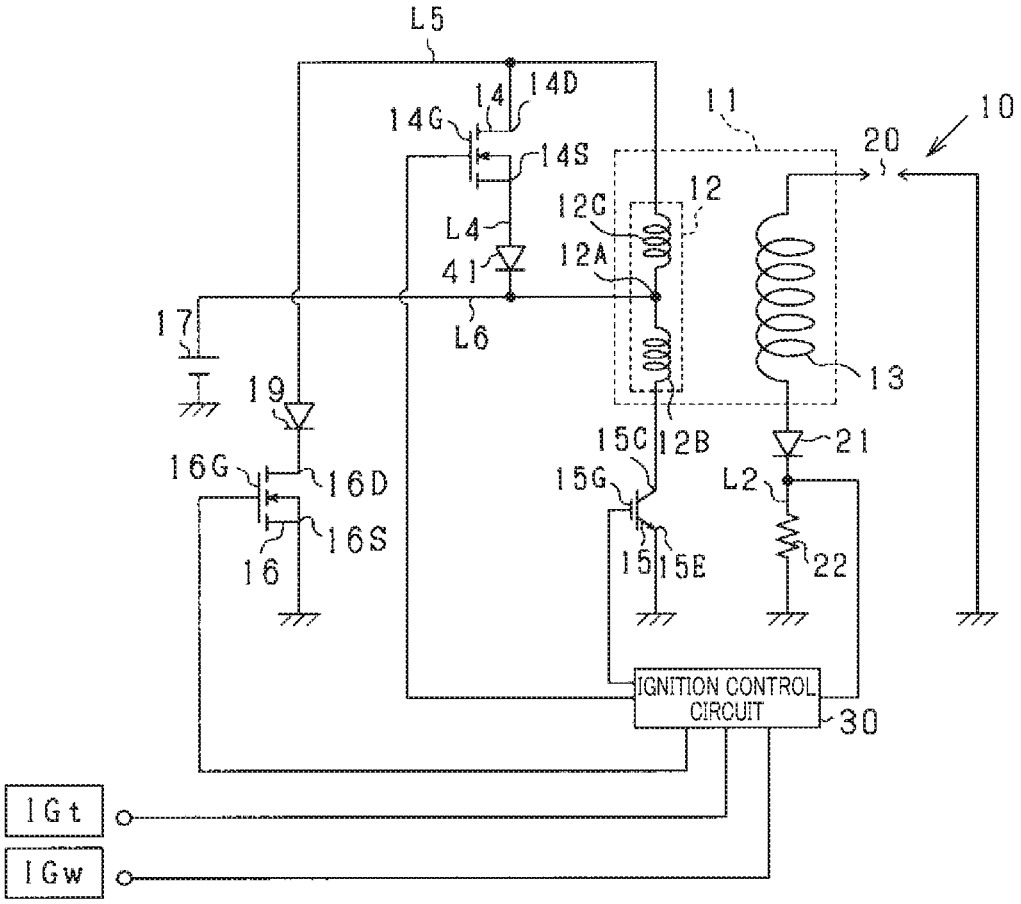
FIG. 25 is a diagram showing an example of changing the installation position of a third diode in the other example shown in FIG. 23.

The position of the third diode 19 can be changed from the position shown in FIG. 23 to the position shown in FIG. 25. That is, as in the first embodiment, the cathode side of the third diode 19 is connected to the second switching element 16, and the anode side is connected to an end of the second winding 12C on the second switching element 16 side. The third diode 19 and the second switching element 16 may be arranged in reverse.

Third Embodiment

The following describes the third embodiment focusing on differences from the second embodiment described above.

Figure 26:
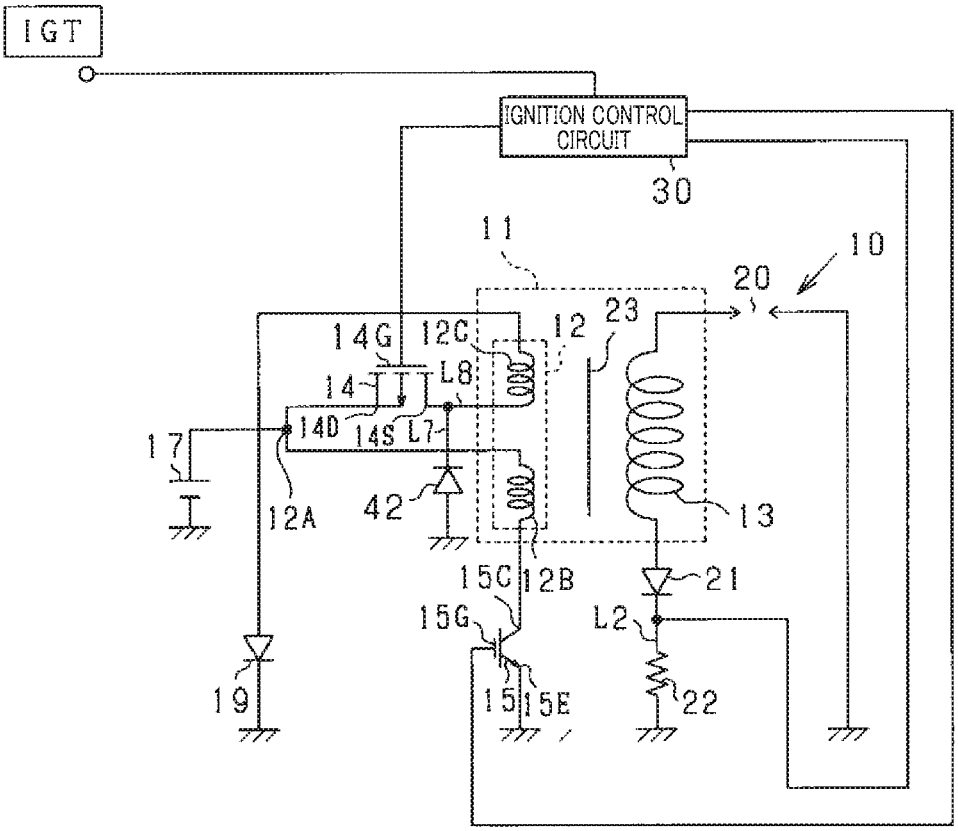
FIG. 26 is a schematic block diagram of an ignition system according to a third embodiment.

In the second embodiment, the second power supply side terminal 16D of the second switching element 16 is connected to the second winding 12C via the third diode 19, and the second ground side terminal 16S is grounded. In this respect, as shown in FIG. 26, the second switching element 16 is omitted, and a third switching element 14 is added. A third power supply side terminal 14D of the third switching element 14 is connected to the center tap 12A, and a third ground side terminal 14S of the third switching element 14 is connected to the second winding 12C. A cathode side of a fourth diode 42 provided in a current circulation path L7 is connected to a current path L8 between the third switching element 14 and the second winding 12C, and an anode side of the fourth diode 42 is grounded. Accordingly, during a period of discharge maintenance control, the primary current I1 flowing through the current circulation path L7 does not flow to the first winding 12B, but directly flows to the second winding 12C. Thus, it is possible to control the primary current I1 with high accuracy, without being influenced by the first winding 12B.

The cathode side of the third diode 19 is connected to the ground side, and the anode side is connected to an end of the second winding 12C on the side opposite to the center tap 12A side. This makes it possible to suppress current flow from the second switching element 16 to the power supply unit 17 via the second winding 12C during discharge start control, and to prevent a decrease in the voltage generated by the discharge start control.

Figure 27:
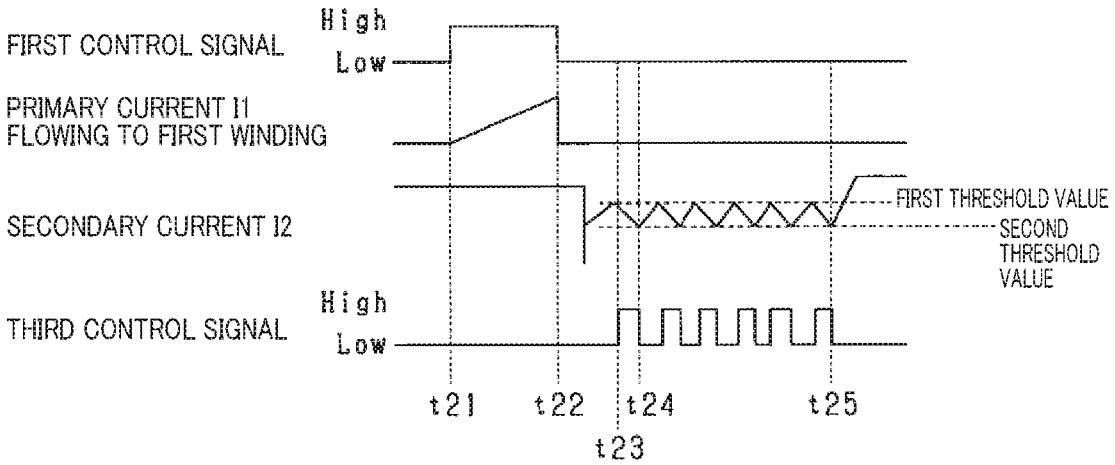
FIG. 27 is a timing diagram showing operation of discharge control according to the third embodiment.

An aspect of the discharge control according to the present embodiment will be described with reference to FIGS. 26 and 27.

Discharge generation control is performed by the ignition control circuit 30 based on an ignition signal IGt output from the engine ECU. In the discharge generation control, a first control signal is transmitted to the first control terminal 15G of the first switching element 15 (see time t21). The first switching element 15 is thereby controlled to be in a closed state while the third switching element 14 is in an open state. As a result, the primary current I1 flows from the power supply unit 17 to the first winding 12B, and the primary current I1 flowing to the first winding 12B increases.

After the lapse of a first predetermined time, the output of the first control signal is stopped (see time t22). The first switching element 15 is thereby controlled to be in an open state, the conduction of the primary current I1 flowing to the first winding 12B is interrupted, a high voltage is induced in the secondary coil 13, and the ignition plug 20 generates a spark discharge.

Then, discharge maintenance control is performed by the ignition control circuit 30. In the discharge maintenance control, the secondary current I2 flowing through the current detection path L2 is sequentially detected by the ignition control circuit 30. When the absolute value of the detected secondary current I2 becomes smaller than the first threshold value, a third control signal is transmitted to the third control terminal 14G of the third switching element 14 (see time t23). The third switching element 14 is thereby controlled to be in a closed state, and the primary current I1 flows from the power supply unit 17 to the second winding 12C.

When the absolute value of the detected secondary current I2 becomes larger than the second threshold value, the output of the third control signal is stopped (see time t24). The third switching element 14 is thereby controlled to be in an open state, the primary current I1 flowing from the power supply unit 17 to the second winding 12C is interrupted, and the primary current I1 is circulated to the second winding 12C via the current circulation path L7 and decays. Subsequently, opening and closing operation of the third switching element 14 is controlled so that the absolute value of the secondary current I2 detected in the current detection path L2 is larger than the first threshold value and smaller than the second threshold value, whereby the ignition plug 20 continues to generate a spark discharge until the discharge period ends (see times t23 to t25).

Thus, the primary current I1 flowing to the first winding 12B can be conducted and interrupted by controlling the third switching element 14 to be in an open state, and then switching the first switching element 15. Further, the primary current I1 flowing to the second winding 12C can be conducted and circulated by controlling the first switching element 15 to be in an open state, and then switching the third switching element 14. Moreover, in the above configuration, the third switching element 14 is omitted from the energization path from the power supply unit 17 to the center tap 12A. Therefore, when the primary current I1 flows from the power supply unit 17 to the first winding 12B, it is possible to eliminate loss caused by passing through the third switching element 14, and to improve the efficiency of discharge generation control.

Many of the components constituting the ignition system 10 are accommodated in a case 50 in which the ignition coil 11 is accommodated. In the third embodiment, a predetermined space is also formed between the iron core 23 and the case 50, and the first switching element 15, the third switching element 14, the current circulation path L7, the current detection path L2, and the ignition control circuit 30 are provided in the predetermined space.

That is, the present internal combustion engine ignition system can be accommodated in a space in which the ignition coil 11 of the ignition plug 20 is accommodated. Accordingly, the wiring can be reduced, and the enlargement of the internal combustion engine ignition system can be suppressed, so that vehicle mountability can be improved.

The third embodiment can also be carried out with the following modifications.

Figure 28:
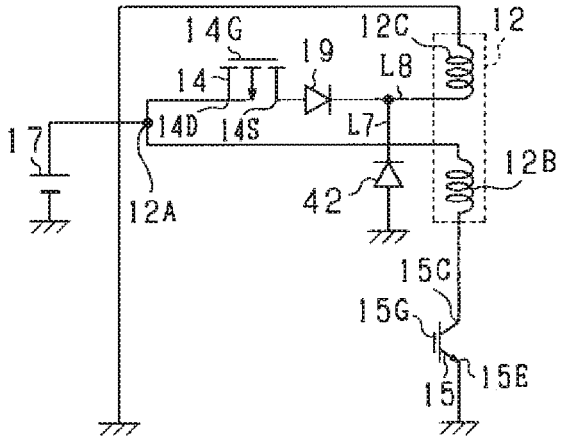
FIG. 28 is a diagram showing another example of the installation position of a third diode applied to the third embodiment.

In the third embodiment, the cathode side of the third diode 19 is connected to the ground side, and the anode side is connected to an end of the second winding 12C on the side opposite to the center tap 12A side. In this respect, as shown in FIG. 28, the third diode 19 may be configured so that its cathode side is connected to an end of the second winding 12C on the center tap 12A side, while its anode side is connected to the third switching element 14.

Figure 29:
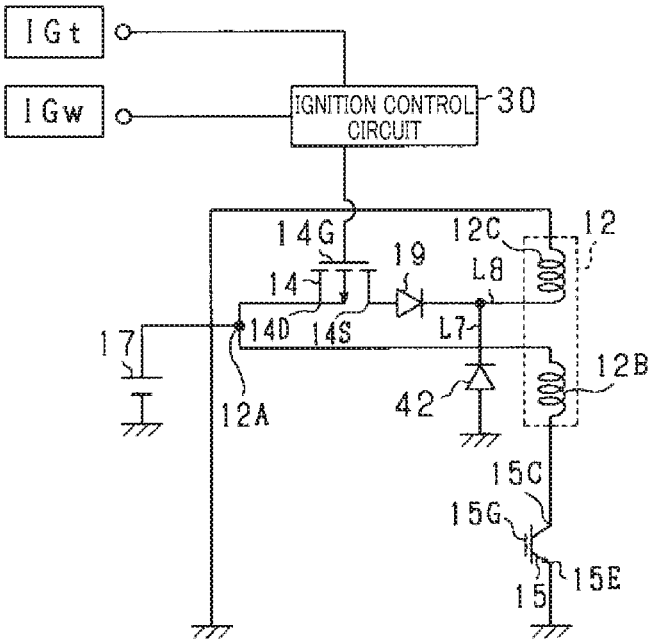
FIG. 29 is a schematic block diagram showing another example of the ignition system according to the third embodiment.

In this case, as shown in FIG. 29, the ignition control circuit 30 may be connected to an engine ECU (not shown) so as to receive an ignition signal IGt and an energy supply signal IGw output from the engine ECU. The ignition control circuit 30 sets the energization period of the first winding 12B based on the ignition signal IGt, and sets the command value of the secondary current I2 and the end timing of discharge maintenance control based on the energy supply signal IGw. Further, the ignition control circuit 30 is connected to the third control terminal 14G so as to control opening and closing operation of the third switching element 14. The third diode 19 and the third switching element 14 may be arranged in reverse.

Figure 30:
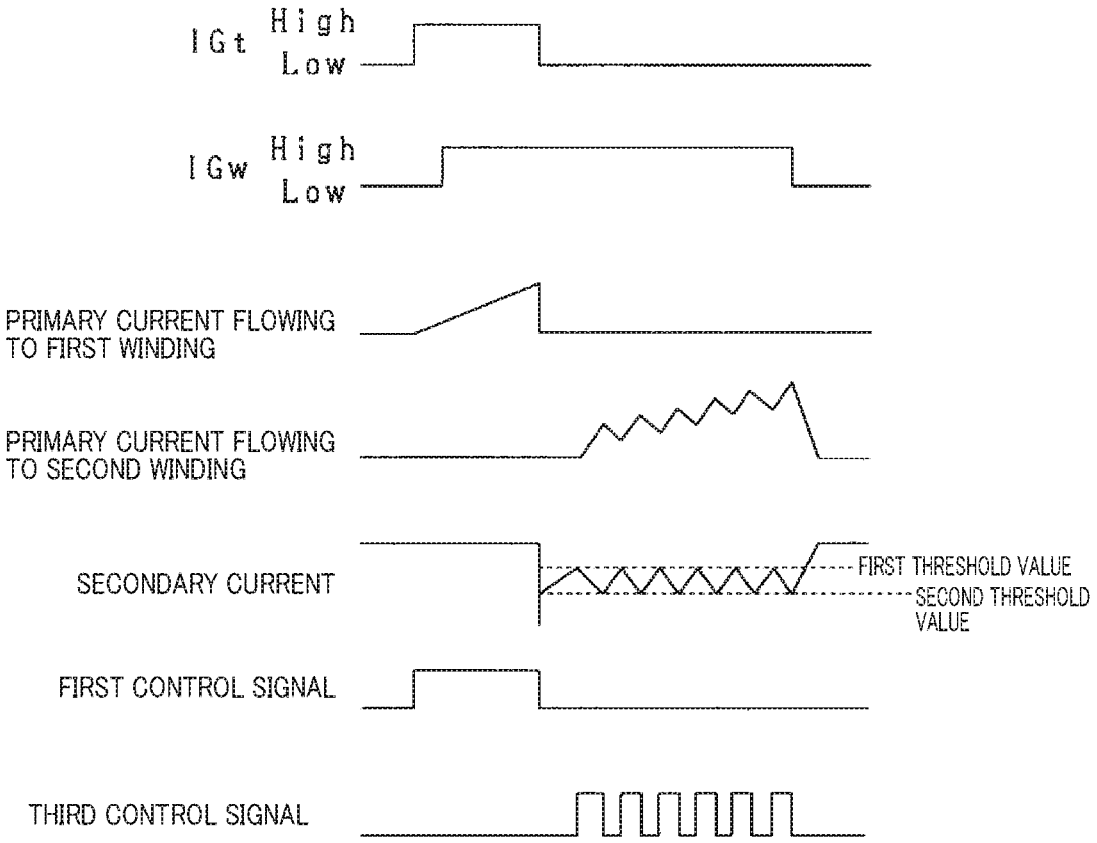
FIG. 30 is a timing diagram showing operation of discharge control according to the other example shown in FIG. 29.

As shown in FIG. 30, during the period in which the discharge start control is performed, the third switching element 14 is controlled to be in an open state by the third control signal. Then, when the ignition signal IGt rises, the first switching element 15 is controlled to be in a closed state by the first control signal, and the primary current I1 flows from the power supply unit 17 to the first winding 12B. When the ignition signal IGt falls, the first switching element 15 is controlled to be in an open state by the first control signal. The conduction of the primary current I1 flowing from the power supply unit 17 to the first winding 12B is thereby interrupted, a high voltage is induced in the secondary coil 13, and the gas in the spark gap unit of the ignition plug 20 undergoes dielectric breakdown, so that a spark discharge is generated in the ignition plug 20.

After the discharge start control is preformed, discharge maintenance control is performed. During the period in which the discharge maintenance control is performed, the first switching element 15 is controlled to be in an open state by the first control signal. In this state, the third switching element 14 is controlled to be in a closed state by the third control signal, whereby the primary current I1 flows from the power supply unit 17 to the second winding 12C. When the absolute value of the secondary current I2 becomes larger than the second threshold value, the third switching element 14 is controlled to be in an open state by the third control signal, whereby the conduction of the primary current I1 flowing from the power supply unit 17 to the second winding 12C is interrupted. The primary current I1 is thereby circulated to the second winding 12C via the current circulation path L7, the current of the second winding 12C gradually decays, and the secondary current I2 also decreases. When the absolute value of the secondary current I2 becomes smaller than the first threshold value, the third switching element 14 is controlled to be in a closed state again by the third control signal.

In the third embodiment, during the period in which the discharge maintenance control is performed, the third switching element 14 is controlled to be in a closed state when the absolute value of the detected secondary current I2 becomes smaller than the first threshold value, and the third switching element 14 is controlled to be in an open state when the absolute value of the detected secondary current I2 becomes larger than the second threshold value. In this respect, opening and closing of the third switching element 14 may be controlled for a predetermined time, regardless of the value of the secondary current I2. For example, during the period in which the discharge maintenance control is performed, the open and closed state of the third switching element 14 may be switched every time a second predetermined time elapses. In this case, it is not necessary to detect the secondary current I2 during the period in which the discharge maintenance control is performed. Thus, it is not necessary to form the current detection path L2, thereby making it possible to reduce the size and cost of the ignition system 10.

In the discharge generation control according to the third embodiment, the first switching element 15 is controlled to be in a closed state while the third switching element 14 is in an open state, and the first switching element 15 is controlled to be in an open state after the lapse of the first predetermined time.

Figure 31:
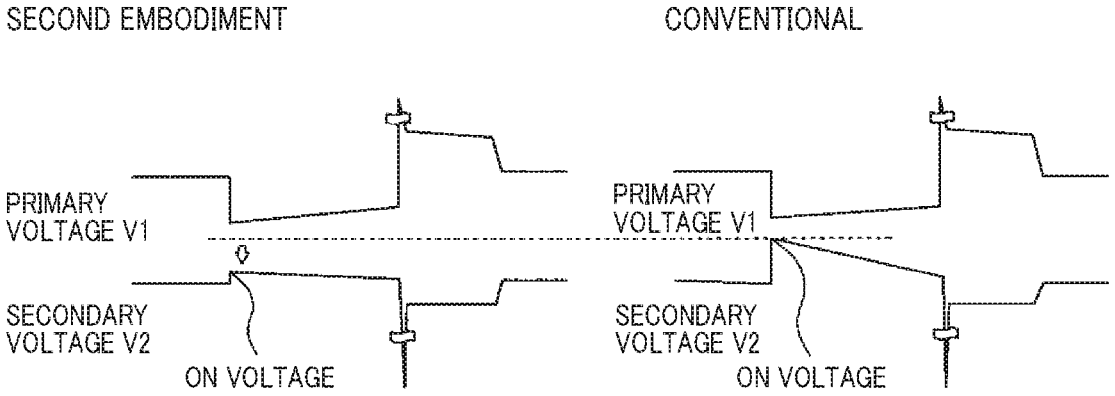
FIG. 31 is a diagram comparing a secondary voltage generated by discharge generation control according to another example applied to the third embodiment and a secondary voltage generated by conventional discharge generation control.

In this respect, during discharge generation control, the first switching element 15 may be controlled to be in a closed state, whereby the primary current I1 flows from the power supply unit 17 to the first winding 12B, while the third switching element 14 is controlled to be in a closed state. Accordingly, the primary current I1 also flows to the second winding 12C. As a result, the first winding 12B and the second winding 12C generate magnetic fluxes in directions in which their magnetic fluxes are cancelled with each other. In this manner, as shown in FIG. 31, the secondary voltage V2 generated by performing discharge generation control can also suppress so-called on-voltage generated by performing conventional discharge generation control to be low. Consequently, voltage applied to the protective diode 21 can be lowered, the breakdown voltage of the protective diode 21 can be reduced, or the protective diode 21 can be omitted. Thus, the cost of the ignition system 10 can be reduced.

Each of the above embodiments can also be carried out with the following modifications.

Figure 32:
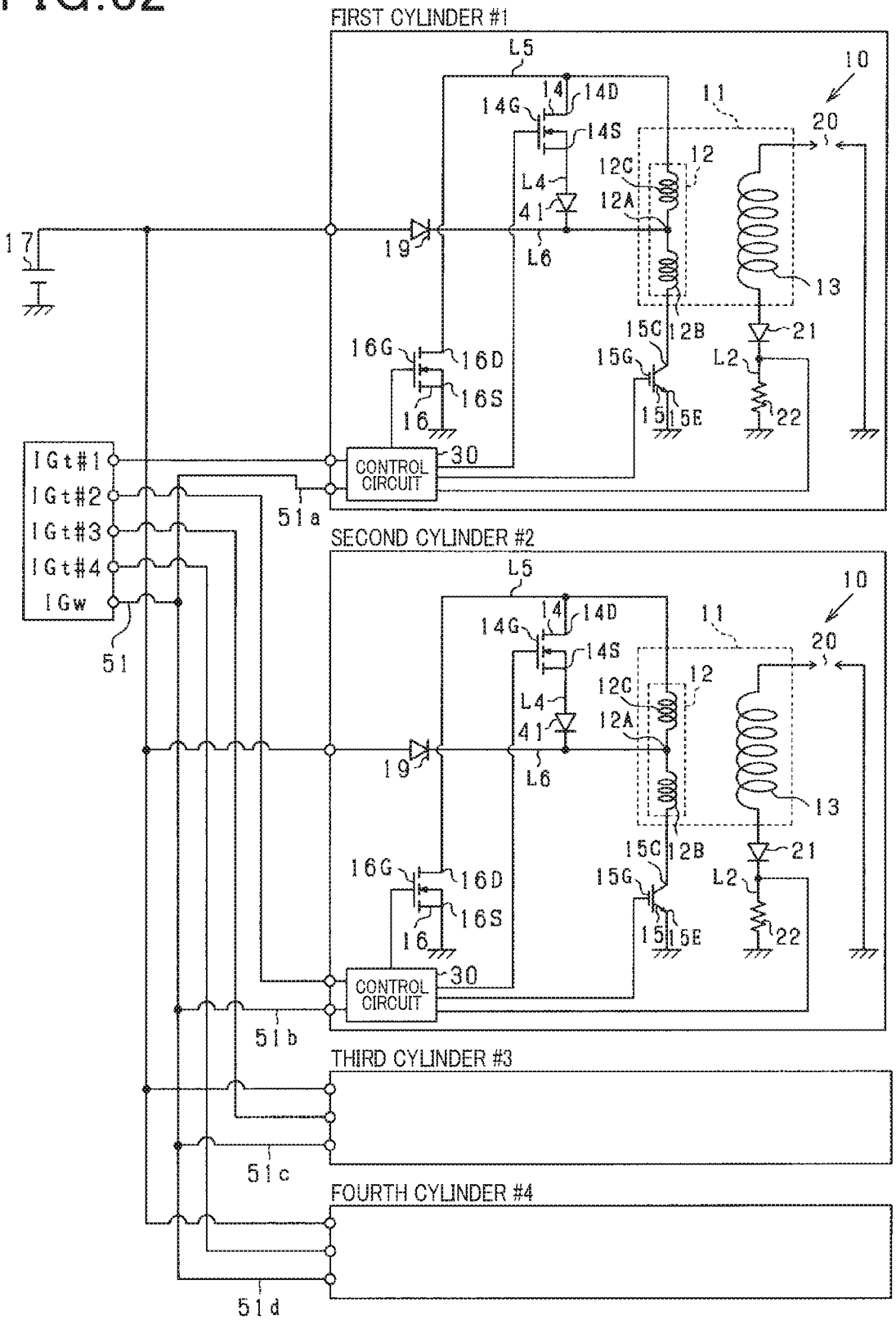
FIG. 32 is a schematic block diagram showing connections between an engine ECU applied to a 4-cylinder engine, and respective ignition control circuits.

In each of the above embodiments, the signal line for transmitting the ignition signal IGt to the ignition coil 11, and the signal line for transmitting the energy supply signal IGw are independently connected from the engine ECU (not shown). In contrast, as shown in FIG. 32, a common signal line 51 for transmitting the energy supply signal IGw may be connected to an engine ECU 61 (control device). Further, signal lines 51*a* to 51*d* branching from the signal line 51 may be connected to the ignition control circuit 30 of each cylinder. That is, the energy supply signal IGw may be common in all the cylinders #1 to #4. The ignition signals IGt are individual signals corresponding to the respective cylinders.

Figure 33:
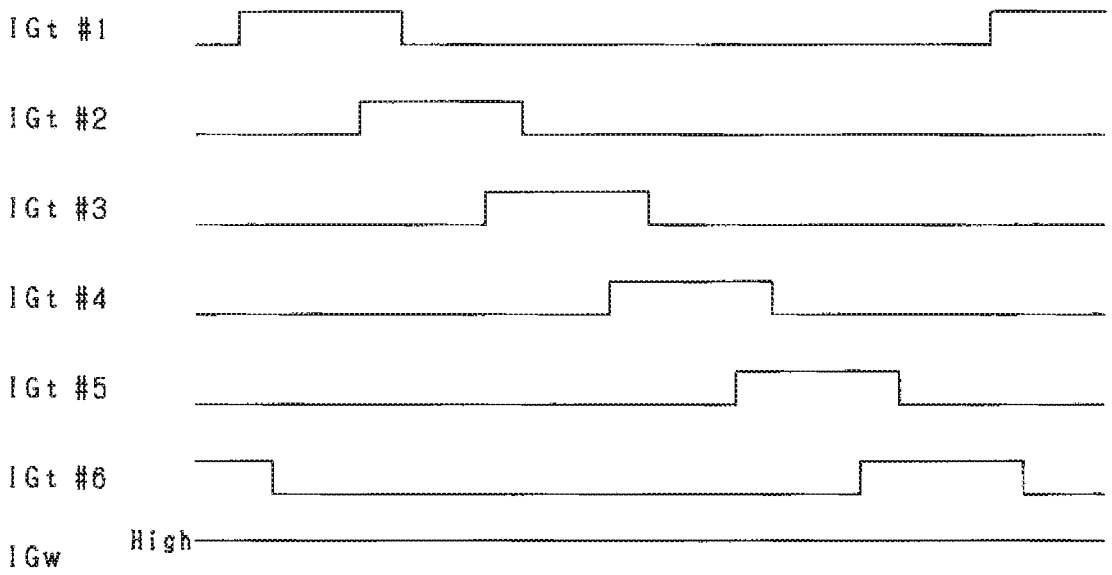
FIG. 33 is a timing diagram showing ignition signals and an energy supply signal of a comparative example.

As shown in FIGS. 12 to 15, 18, 24, and 30, for example, the high period of the energy supply signal IGw continues from the period when the ignition signal IGt is high to the time when discharge maintenance control ends. Therefore, when the engine 60 is a multi-cylinder engine (e.g., a V-type 6-cylinder engine), if the energy supply signal IGw is common, the energy supply signal IGw may always be high, as shown in FIG. 33. That is, in cylinders in which ignition by the ignition plug 20 continues, the high periods of the energy supply signal IGw may overlap with each other.

Figure 34:
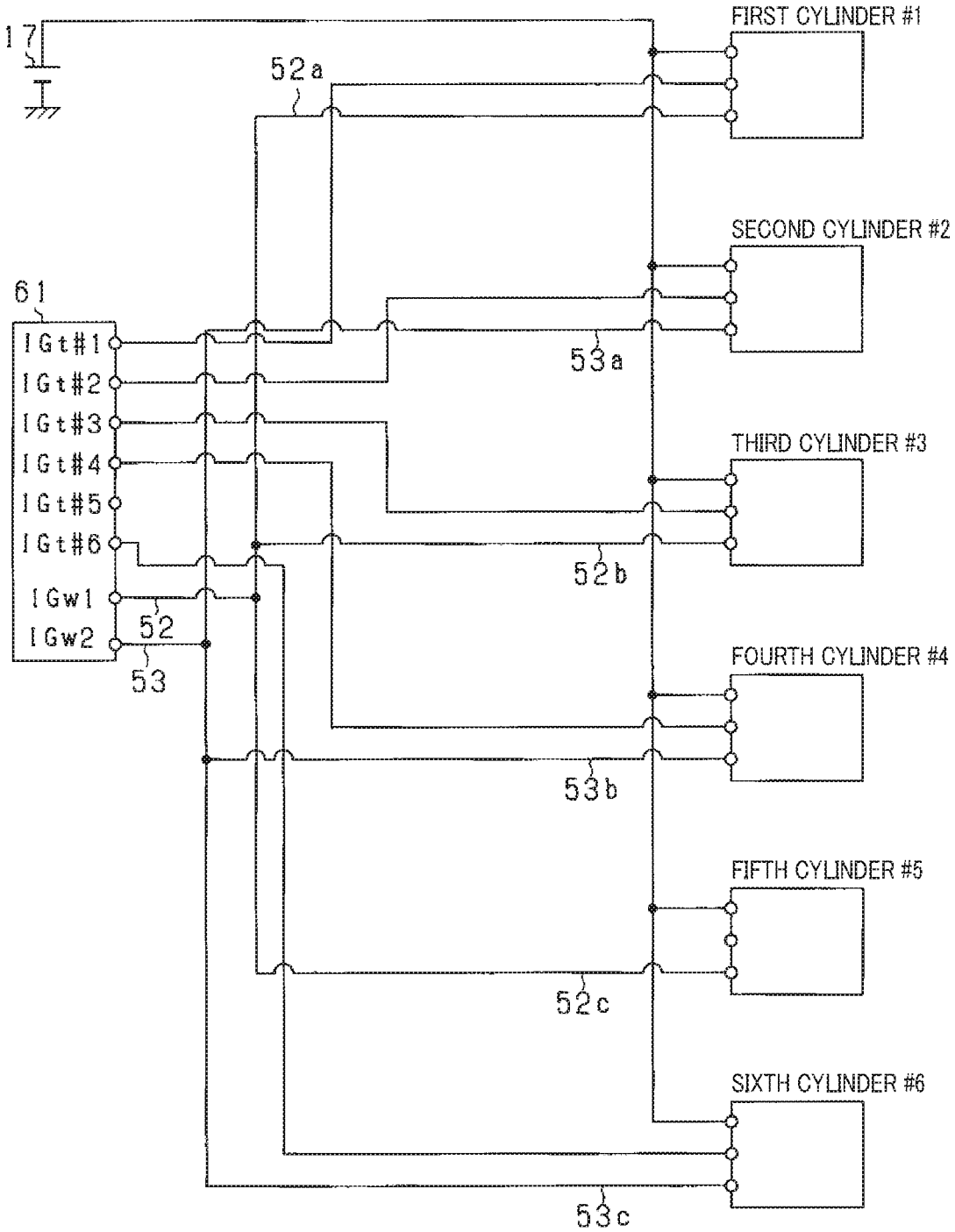
FIG. 34 is a schematic block diagram showing connections between an engine ECU applied to a 6-cylinder engine, and respective ignition control circuits.

Therefore, as shown in FIG. 34, a common signal line 52 for transmitting an energy supply signal IGw1 and a common signal line 53 for transmitting an energy supply signal IGw2 may be connected to the engine ECU 61. That is, the energy supply signal IGw1 may be common in some cylinders #1, #3, and #5 (one bank). The energy supply signal IGw2 may be common in some cylinders #2, #4, and #6 (the other bank). The ignition signals IGt are individual signals corresponding to the respective cylinders.

Further, signal lines 52*a* to 52*c* branching from the signal line 52 (first common signal line) may be connected to the ignition control circuits 30 of the first cylinder #1, the third cylinder #3, and the fifth cylinder #5, respectively. The first cylinder #1, the third cylinder #3, and the fifth cylinder #5 (first cylinder group) are a group of cylinders in which ignition is not continually caused by the ignition plug 20. Moreover, signal lines 53*a* to 53*c* branching from the signal line 53 (second common signal line) may be connected to the ignition control circuits 30 of the second cylinder #2, the fourth cylinder #4, and the sixth cylinder #6, respectively. The second cylinder #2, the fourth cylinder #4, and the sixth cylinder #6 (second cylinder group) are a group of cylinders in which ignition is not continually caused by the ignition plug 20, and which are not included in the first cylinder group. That is, while ignition is performed in tandem in two cylinders (e.g., the first cylinder #1 and the third cylinder #3) included in the first cylinder group, ignition is performed in one cylinder (e.g., the second cylinder #2) included in the second cylinder group.

Figure 35:
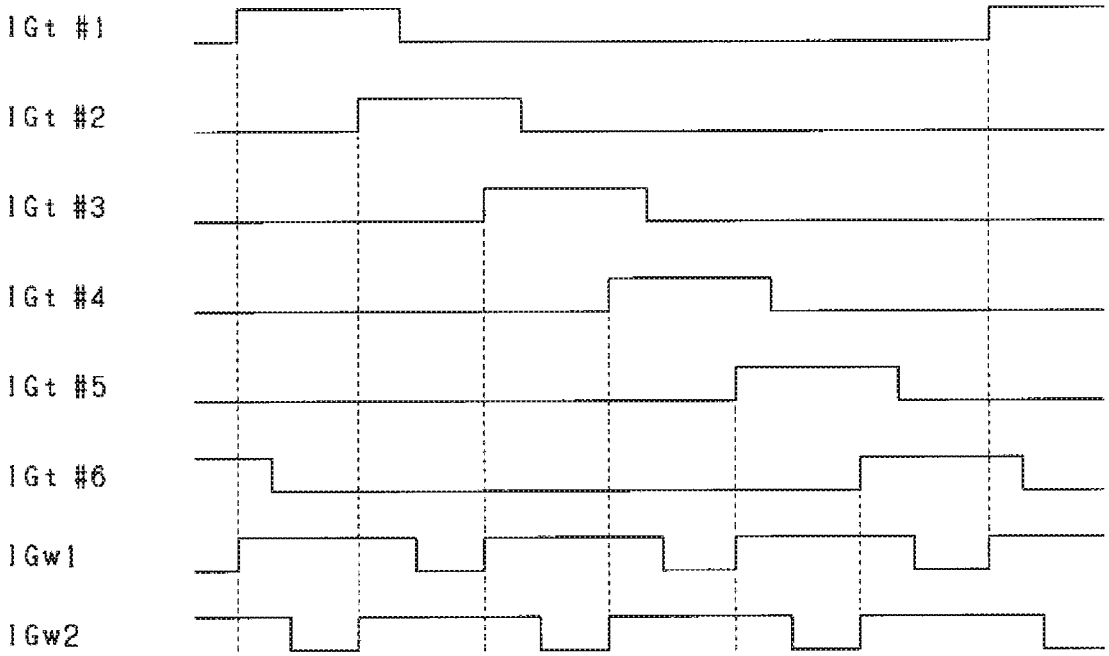
FIG. 35 is a timing diagram showing ignition signals and energy supply signals of the embodiment shown in FIG. 34.

With this configuration, it is possible to avoid a situation in which the energy supply signals IGw1 and IGw2 are always high, as shown in FIG. 35. That is, the ignition in the first cylinder #1, the third cylinder #3, and the fifth cylinder #5 of the first cylinder group does not continue, and it is possible to prevent the overlapping of the high periods of the energy supply signal IGw1 transmitted to the first cylinder #1, the third cylinder #3, and the fifth cylinder #5 of the first cylinder group. Further, the ignition in the second cylinder #2, the fourth cylinder #4, and the sixth cylinder #6 of the second cylinder group does not continue, and it is possible to prevent the overlapping of the high periods of the energy supply signal IGw2 transmitted to the second cylinder #2, the fourth cylinder #4, and the sixth cylinder #6 of the second cylinder group. Therefore, even when the engine 60 is a multi-cylinder engine, the command value of the secondary current I2 and the end timing of discharge maintenance control can be set based on the energy supply signals IGw1 and IGw2.

The engine 60 is not limited to a 6-cylinder engine, and may be an 8-cylinder engine, a 10-cylinder engine, or the like. Further, the cylinders of the engine 60 may be divided into three or more cylinder groups. The cylinders of each cylinder group may be a group of cylinders in which ignition is not continually caused by the ignition plug 20. Specifically, while ignition is performed in tandem in two cylinders included in each cylinder group (e.g., first cylinder group), ignition may be performed in cylinders included in another cylinder group (e.g., second cylinder group).

Figure 36:
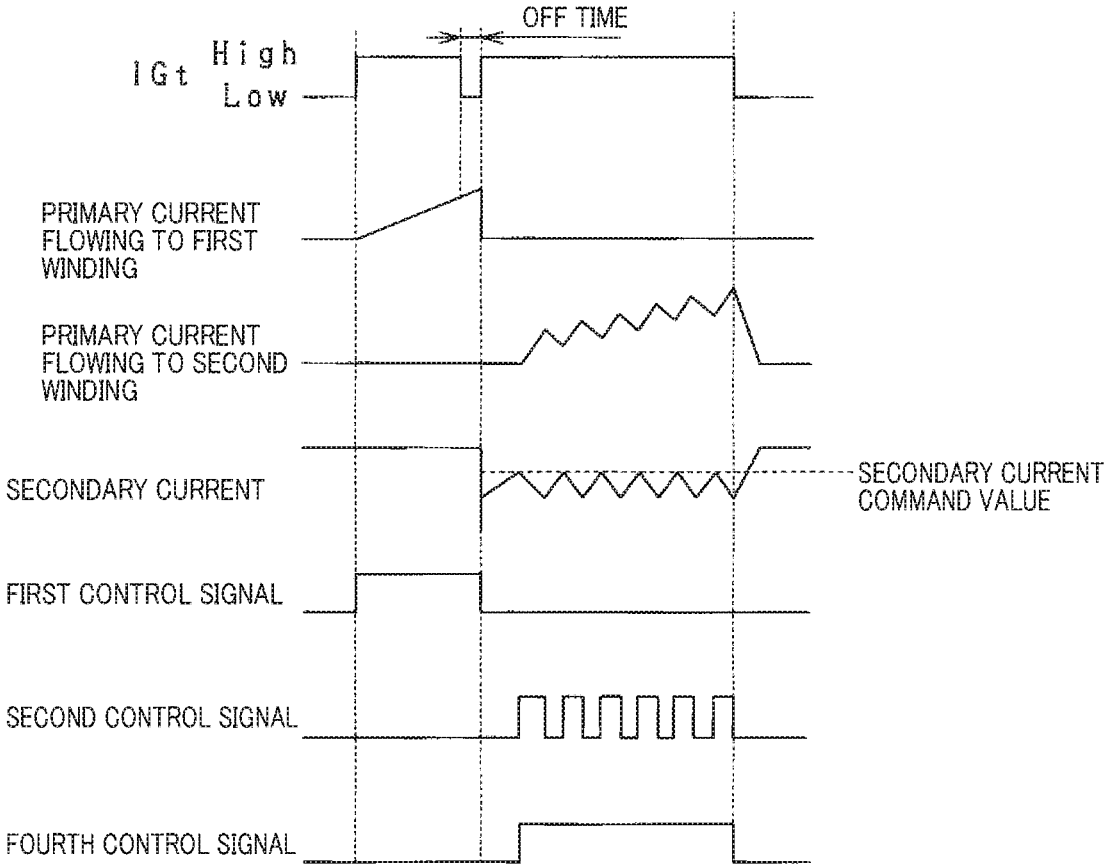
FIG. 36 is a timing diagram showing operation of discharge control only by an ignition signal.

When energy supply control is performed by one signal line for transmitting an ignition signal IGt, as shown in FIGS. 1, 16, 19, 20, and 26, information included in the ignition signal IGt and the energy supply signal IGw can be superimposed only on the ignition signal IGt, as shown in FIG. 36. That is, after the discharge start control is started, energization of the first winding 12B is started by the first control signal at the first rise of the ignition signal IGt, and the energization of the first winding 12B is stopped at the second rise. Then, the discharge maintenance control is stopped at the second fall of the ignition signal IGt.

Figure 37:
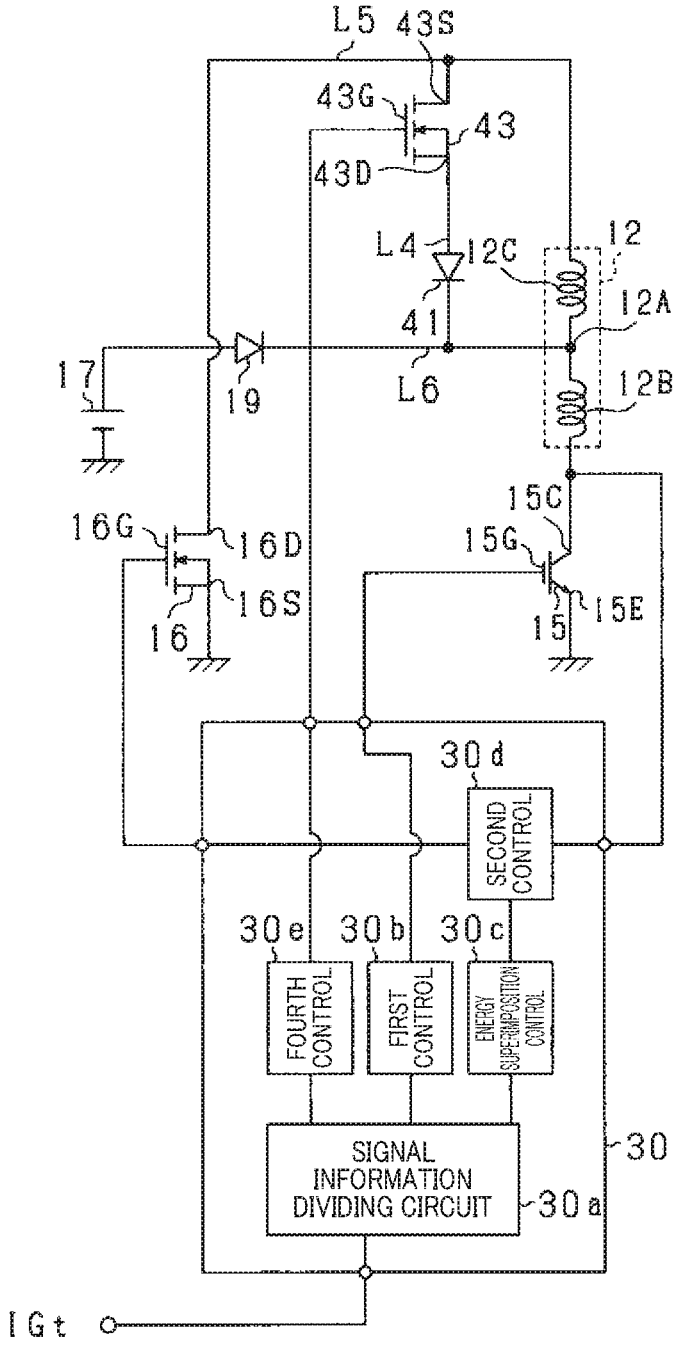
FIG. 37 is a schematic block diagram of an ignition system that performs the discharge control of FIG. 36.

Specifically, as shown in FIG. 37, the ignition control circuit 30 includes a signal information dividing circuit 30*a*, a first control unit 30*b*, an energy superimposition control unit 30*c*, a second control unit 30*d*, a fourth control unit 30*e*, and the like. The signal information dividing circuit 30*a* detects the rise timing and fall timing of the ignition signal IGt, and counts the number of times of rise and the number of times of fall. The first control unit 30*b* and the fourth control unit 30*e* create a first control signal and a fourth control signal, respectively, based on the information from the signal information dividing circuit 30*a*. The energy superimposition control unit 30*c* and the second control unit 30*d* create a second control signal based on the information from the signal information dividing circuit 30*a* and the detected secondary current I2. Specifically, the configuration disclosed in JP 4736942 B can be adopted. The setting of the energization period of the first winding 12B based on the ignition signal IGt, and the setting of the command value of the secondary current I2 and the end timing of discharge maintenance control can also be applied to other embodiments and their modifications.

In each of the above embodiments, the switching elements are assumed to be MOSFETs (third switching element 14 and second switching element 16) but instead may be IGBTs, power transistors, thyristors, triacs, or the like, in place of MOSFETs. Similarly, the switching element assumed to be an IGBT (first switching element 15) may be a MOSFET, a power transistor, a thyristor, a triac, or the like.

In each of the above embodiments, the first switching element 15 may be connected in reverse parallel to a fifth diode 15D (shown by the dotted line in FIG. 1). If discharge maintenance control is performed in the absence of the current circulation path L1 in the first embodiment, the primary current I1 flowing to the second winding 12C and then flowing from the second winding 12C to the second switching element 16 is circulated via the fifth diode 15D connected in reverse parallel to the first switching element 15, and the first winding 12B. In this case, the amount of the circulating current decreases due to the influence of the first winding 12B, and the secondary current I2 generated in the secondary coil 13 decreases accordingly. Thus, the controllability may be reduced. In this respect, since the current circulation path L1 is provided, the current is circulated to the second winding 12C via the current circulation path L1 during discharge maintenance control. This makes it possible to suppress a decrease in the secondary current I2 flowing to the ignition plug 20. Thus, the ignition system 10 is considered to be suitable for a configuration in which the fifth diode 15D is connected in reverse parallel to the first switching element 15.

In each of the above embodiments, the discharge maintenance voltage is set within a range of 2 to 3 kV. In this respect, for example, the discharge maintenance voltage may be set to a value larger than 3 kV or smaller than 2 kV, depending on the combustion state of the engine 60.

In the first embodiment and the second embodiment, the third diode 19 is provided, the cathode side of which is connected to the second switching element 16, and the anode side of which is connected to an end of the second winding 12C on the second switching element 16 side. Moreover, in the third embodiment, the third diode 19 is provided, the cathode side of which is connected to the ground side, and the anode side of which is connected to an end of the second winding 12C on the side opposite to the center tap 12A side. In this respect, as a configuration in which the third diode 19 is not provided, the second switching element 16 and the third switching element 14 may be provided with an element (diode) having a backflow prevention function.

In each of the above embodiments, the ignition control circuit 30 generates and controls each control signal based on the ignition signal IGt received from the engine ECU. However, there is no limitation thereto. The ignition control circuit 30 may individually receive any of the control signals from the engine ECU and perform the control.

In each of the above embodiments, the case 50 contains the ignition system 10, except for the power supply unit 17 and the ignition plug 20. In this respect, the number of components of the ignition system 10 accommodated in the case 50 may be reduced. For example, the ignition control circuit 30 may be omitted, and the control performed by the ignition control circuit 30 may be performed by an engine ECU present outside the case 50. In this case, the engine ECU corresponds to the ignition control circuit.

Each of the above embodiments has described an example in which a diode is provided in a current circulation path (corresponding to the first diode 18 of the current circulation path L1 in the first embodiment). However, there is no limitation thereto. For example, a semiconductor switch element may be provided to perform opening and closing control, e.g., closing when circulation operation is performed.

The present disclosure is described according to embodiments. However, it is understood that the present disclosure is not limited to the embodiments and the configurations thereof. The present disclosure also includes various modified examples and modifications within an equivalent range. In addition, various combinations and manners, and other combinations and manners including more, less, or only a single element, are also within the spirit and scope of the present disclosure.

A first disclosure is an internal combustion engine ignition system, including: an ignition plug (20) that generates a spark discharge for igniting a combustible mixture in a combustion chamber of an internal combustion engine (60); an ignition coil (11) including a primary coil (12) and a secondary coil (13), and applying a voltage to the ignition plug by the secondary coil; a voltage application unit (17) that applies a predetermined voltage to the primary coil; a third switching element (14) conducting and interrupting a primary current flowing from the voltage application unit to a center tap (12A) provided in the middle of a winding that forms the primary coil; a first switching element (15) connected between a ground side and one end of the winding forming the primary coil on a side of a first winding, which is a winding from the center tap to one end; a second switching element (16) connected between the ground side and one end of the winding forming the primary coil on a side of a second winding (12C), which is a winding from the center tap to the other end; an ignition control circuit (30) that controls open and closed states of the first switching element, open and closed states of the second switching element, and open and closed states of the third switching element, thereby conducting and interrupting the primary current flowing to the first winding to perform discharge generation control that allows the ignition plug to generate the spark discharge, and thereby conducting and interrupting the primary current flowing to the second winding to perform discharge maintenance control that maintains the spark discharge generated in the ignition plug; and a current circulation path (L1) that circulates a current flowing from the second winding to the second switching element.

In the discharge generation control, the open and closed state of the first switching element, the open and closed state of the second switching element, and the open and closed state of the third switching element are each controlled to conduct and interrupt the primary current flowing to the first winding, whereby the ignition plug generates a spark discharge. Further, in the discharge maintenance control, the open and closed state of the first switching element, the open and closed state of the second switching element, and the open and closed state of the third switching element are each controlled to conduct and interrupt the primary current flowing to the second winding, whereby the spark discharge generated in the ignition plug is maintained. In this case, if there is no current circulation path, when the first switching element and the third switching element are in open states during discharge maintenance control, the primary current flowing to the second winding does not flow and is interrupted. There is a concern that the secondary current flowing to the ignition plug may significantly decrease in steps during that period. In this respect, since the present internal combustion engine ignition system is provided with a current circulation path, even when the first switching element and the third switching element are in open states during discharge maintenance control, the primary current gradually decays while flowing from the current circulation path to the second winding. This can suppress the secondary current flowing to the ignition plug from rapidly decreasing in steps. Furthermore, when the first switching element is provided with a reverse diode, there is a current circulation path for the second winding 12C via the reverse diode and the first winding 12B. However, the circulating current of the second winding 12C decreases upon the influence of voltage generated in the first winding 12B, and the secondary current rapidly decreases as well.

According to a second disclosure, regarding the first disclosure, the current circulation path (L1) includes a first diode (18), a cathode side of the first diode is connected to the center tap, and an anode side of the first diode is connected to the ground side.

Accordingly, during a period of discharge maintenance control, the primary current flowing through the current circulation unit does not flow to the first winding, but directly flows to the second winding. Thus, it is possible to control the primary current with high accuracy, without being influenced by the first winding.

According to a third disclosure, regarding the first or second disclosure, the ignition control circuit conducts and interrupts the primary current flowing to the first winding by controlling the second switching element to be in an open state, then controlling the first switching element and the third switching element to be in closed states, and thereafter controlling the first switching element to be in an open state; and the ignition control circuit conducts and circulates the primary current flowing to the second winding by controlling the first switching element to be in an open state, then controlling the second switching element and the third switching element to be in closed states, and thereafter controlling the third switching element to be in an open state.

With the above configuration, the primary current flowing to the first winding can be conducted and interrupted by controlling the second switching element to be in an open state, controlling the third switching element to be in a closed state, and then switching the first switching element. Further, the primary current flowing to the second winding can be conducted and circulated by controlling the first switching element to be in an open state, controlling the second switching element to be in a closed state, and then switching the third switching element.

According to a fourth disclosure, regarding the first or second disclosure, the ignition control circuit conducts and interrupts the primary current flowing to the first winding by controlling the second switching element to be in an open state, then controlling the first switching element and the third switching element to be in a closed state, and thereafter controlling the first switching element to be in an open state; and the ignition control circuit conducts and interrupts the primary current flowing to the second winding by controlling the first switching element to be in an open state, then controlling the second switching element and the third switching element to be in closed states, and thereafter controlling the second switching element to be in an open state.

A fifth disclosure is an internal combustion engine ignition system, including: an ignition plug (20) that generates a spark discharge for igniting a combustible mixture in a combustion chamber of an internal combustion engine (60); an ignition coil (11) including a primary coil (12) and a secondary coil (13), and applying a voltage to the ignition plug by the secondary coil; a voltage application unit (17) applying a predetermined voltage to a center tap (12A) provided in the middle of a winding that forms the primary coil; a first switching element (15) connected between a ground side and one end of the winding forming the primary coil on a side of a first winding (12B), which is a winding from the center tap to one end; a second switching element (16) connected between the ground side and one end of the winding forming the primary coil on a side of a second winding (12C), which is a winding from the center tap to the other end; an ignition control circuit (30) that controls open and closed states of the first switching element and open and closed states of the second switching element, thereby conducting and interrupting a primary current flowing to the first winding to perform discharge generation control that allows the ignition plug to generate the spark discharge, and thereby conducting and interrupting the primary current flowing to the second winding to perform discharge maintenance control that maintains the spark discharge generated in the ignition plug; and a current circulation path (L4) that circulates a current flowing to the second winding when the current flowing to the second winding is interrupted by the second switching element.

In the discharge generation control, the open and closed state of the first switching element and the open and closed state of the second switching element are each controlled to conduct and interrupt the primary current flowing to the first winding, whereby the ignition plug generates a discharge spark. Further, in the discharge maintenance control, the open and closed state of the first switching element and the open and closed state of the second switching element are each controlled to conduct and interrupt the primary current flowing to the second winding, whereby the spark discharge generated in the ignition plug is maintained. In this case, if there is no current circulation path, when the first switching element and the second switching element are in open states during discharge maintenance control, the primary current flowing to the second winding does not flow and is interrupted. There is a concern that the secondary current flowing to the ignition plug may significantly decrease in steps during that period. In this respect, since the present internal combustion engine ignition system is provided with a current circulation path, even when the first switching element and the second switching element are open states during discharge maintenance control, the primary current flows, while decaying, to the second winding from the current circulation path. This can suppress the secondary current flowing to the ignition plug from rapidly decreasing in steps.

According to a sixth disclosure, regarding the fifth disclosure, the current circulation path includes a second diode (41), a cathode side of the second diode is connected to a current path (L6) between the voltage application unit and the center tap, and an anode side of the second diode is connected to a current path (L5) between the second winding and the second switching element.

Accordingly, during a period of discharge maintenance control, the primary current flowing through the current circulation unit does not flow to the first winding, but flows to the second winding while decaying. Thus, it is possible to control the primary current with high accuracy, without being influenced by the first winding.

According to a seventh disclosure, regarding the fifth or sixth disclosure, as the discharge generation control, the ignition control circuit conducts and interrupts a primary current flowing to the first winding by controlling the second switching element to be in an open state, then controlling the first switching element to be in a closed state, and thereafter controlling the first switching element to be in an open state; and as the discharge maintenance control, the ignition control circuit conducts and circulates the primary current flowing to the second winding by controlling the first switching element to be in an open state, then controlling the second switching element to be in a closed state, and thereafter controlling the second switching element to be in an open state.

With the above configuration, the primary current flowing to the first winding can be conducted and interrupted by controlling the second switching element to be in an open state, and then switching the first switching element. Further, the primary current flowing to the second winding can be conducted and circulated by controlling the first switching element to be in an open state, and then switching the second switching element.

According to an eighth disclosure, regarding any one of the first to seventh disclosures, the system includes a third diode (19), a cathode side of which is connected to the second switching element, and an anode side of which is connected to an end on a side opposite to the center tap side.

If a third diode is not provided, performing discharge start control may generate a current flowing from the second switching element to the voltage application unit via the second winding. That is, a magnetic flux generated by the interrupted current of the first winding is interlinked with the second winding, whereby a voltage may be generated at the end of the second winding, and the above current may be generated. In this case, the generated current is offset by the current flowing from the second switching element to the voltage application unit, and the primary current is reduced by the offset amount. As a countermeasure for this, a third diode is provided, a cathode side of which is connected to the second switching element, and an anode side of which is connected to an end of the second winding on the second switching element side, whereby even if a voltage that causes the generation of the above current is generated, it is possible to suppress the current from flowing from the second switching element to the voltage application unit.

According to a ninth disclosure, regarding any one of the first to seventh disclosures, the system includes a third diode (19), a cathode side of which is connected to the center tap, and an anode side of which is connected to the voltage application unit.

Accordingly, even if a voltage is generated by discharge start control to cause a current to flow from the second switching element to the voltage application unit via the second winding, it is possible to suppress the current from flowing from the second switching element to the voltage application unit.

A tenth disclosure is an internal combustion engine ignition system, including: an ignition plug (20) that generates a spark discharge for igniting a combustible mixture in a combustion chamber of an internal combustion engine (60); an ignition coil (11) including a primary coil (12) and a secondary coil (13), and applying a voltage to the ignition plug by the secondary coil; a voltage application unit (17) applying a predetermined voltage to a center tap (12A) provided in the middle of a winding that forms the primary coil; a first switching element (15) connected between a ground side and one end of the winding forming the primary coil on a side of a first winding (12B), which is a winding from the center tap to one end; a third switching element (14) connected between the center tap and a second winding, which is a winding from the center tap to the other end; an ignition control circuit (30) that controls open and closed states of the first switching element and open and closed states of the third switching element, thereby performing discharge generation control that allows the ignition plug to generate the spark discharge, and thereby performing discharge maintenance control that maintains the spark discharge generated in the ignition plug; and a current circulation path (L7) that circulates a current flowing from the second winding to a ground side.

In the discharge generation control, the open and closed state of the first switching element and the open and closed state of the third switching element are each controlled to conduct and interrupt the primary current flowing to the first winding, whereby the ignition plug generates a spark discharge. Further, in the discharge maintenance control, the open and closed state of the first switching element and the open and closed state of the third switching element are each controlled to conduct and interrupt the primary current flowing to the second winding, whereby the spark discharge generated in the ignition plug is maintained. In this case, if there is no current circulation path, when the first switching element and the third switching element are in open states during discharge maintenance control, the primary current flowing to the second winding does not flow and is interrupted. There is a concern that the secondary current flowing to the ignition plug may significantly decrease in steps during that period. In this respect, since the present internal combustion engine ignition system is provided with a current circulation path, even when the first switching element and the third switching element are in open states during discharge maintenance control, the inductance component of the second winding causes the primary current to flow from the current circulation path to the second winding while gradually decaying. This can suppress the secondary current flowing to the ignition plug from rapidly decreasing in steps.

According to an eleventh disclosure, regarding the tenth disclosure, the current circulation path includes a fourth diode (42), a cathode side of the fourth diode is connected to a current path (L8) between the third switching element and the second winding, and an anode side of the fourth diode is connected to a ground side.

Accordingly, during a period of discharge maintenance control, the primary current flowing through the current circulation unit does not flow to the first winding, but directly flows to the second winding. Thus, without being influenced by the first winding, the primary current does not decrease in steps, but gradually decays. When the primary current reaches a predetermined value, a current is supplied again from the third switching element. Since the control to turn off the third switching element when the primary current reaches the predetermined value again is repeated, it is possible to accurately control the primary current to the predetermined value.

According to a twelfth disclosure, regarding the tenth or eleventh disclosure, the system includes a third diode (19), a cathode side of which is connected to the ground side, and an anode side of which is connected to an end of the second winding on a side opposite to the center tap side.

If a third diode is not provided, performing the discharge start control may generate a current flowing from the second winding to the voltage application unit via the third switching element. In this case, a magnetic flux generated by the interrupted current of the first winding is offset by the current flowing from the second switching element to the voltage application unit, and the primary current is reduced by the offset amount. As a countermeasure for this, a third diode is provided, a cathode side of which is connected to the second switching element, and an anode side of which is connected to an end of the second winding on the second switching element side, whereby even if a voltage that causes the generation of the above current is generated by discharge start control, it is possible to suppress the current from flowing from the third switching element to the voltage application unit.

According to a thirteenth disclosure, regarding the tenth or eleventh disclosure, the system includes a third diode (19), a cathode side of which is connected to an end of the second winding on the center tap side, and an anode side of which is connected to the third switching element.

With this configuration, even if a voltage is generated during discharge start control to cause the generation of a current flowing from the second winding to the voltage application unit via the third switching element, the third diode can suppress the current from flowing from the second winding to the third switching element.

According to a fourteenth disclosure, regarding any one of the tenth to thirteenth disclosures, as the discharge generation control, the ignition control circuit conducts and interrupts a primary current flowing to the first winding to start discharge by controlling the third switching element to be in an open state, then controlling the first switching element to be in a closed state, and thereafter controlling the first switching element to be in an open state; and as the discharge maintenance control, the ignition control circuit conducts and circulates the primary current flowing to the second winding by controlling the first switching element to be in an open state, then controlling the third switching element to be in a closed state, and thereafter controlling the third switching element to be in an open state.

With the above configuration, the primary current flowing to the first winding can be conducted and interrupted by controlling the third switching element to be in an open state, and then switching the first switching element. Further, the primary current flowing to the second winding can be conducted and circulated by controlling the first switching element to be in an open state, and then switching the third switching element.

According to a fifteenth disclosure, regarding any one of the tenth to thirteenth disclosures, as the discharge generation control, the ignition control circuit conducts and interrupts a primary current flowing to the first winding and the second winding to start discharge by controlling the first switching element and the third switching element to be in closed states, and then controlling the first switching element and the third switching element to be in open states; and as the discharge maintenance control, the ignition control circuit conducts and circulates the primary current flowing to the second winding by controlling the first switching element to be in an open state, then controlling the third switching element to be in a closed state, and thereafter controlling the third switching element to be in an open state.

When the first switching element and the third switching element are controlled to be in a closed state during discharge generation control, the primary current also flows to the second winding. As a result, the first winding and the second winding generate magnetic fluxes in directions in which their magnetic fluxes are cancelled with each other. It is thereby possible to suppress the so-called on-voltage generated on the secondary side by energization by discharge generation control, and it is possible to omit an on-voltage firing spark protective diode, to reduce the voltage, and to adopt an inexpensive diode.

According to a sixteenth disclosure, regarding any one of the first to fifteenth disclosures, the number of turns of the first winding is greater than the number of turns of the second winding.

During discharge maintenance control, the voltage for maintaining discharge generated in the ignition plug is lower than the voltage required for causing the ignition plug to generate discharge during discharge generation control. Taking this into consideration, the number of turns of the first winding is made greater than the number of turns of the second winding, whereby the secondary voltage generated in the secondary coil when the primary voltage is applied to the second winding can be made lower than the secondary voltage generated in the secondary coil when the primary voltage is applied to the first winding.

According to a seventeenth disclosure, regarding any one of the first to sixteenth disclosures, a turn ratio, which is a value obtained by dividing the number of turns of the secondary coil by the number of turns of the second winding, is larger than a voltage ratio, which is a value obtained by dividing a discharge maintenance voltage as a voltage required to maintain the spark discharge generated in the ignition plug by the discharge generation control, by the voltage applied by the voltage application unit.

The turn ratio is calculated by dividing the number of turns of the secondary coil by the number of turns of the second winding. That is, the smaller the number of turns of the secondary winding, the larger the turn ratio. In this case, when the number of turns of the secondary winding is reduced so that the turn ratio is larger than the ratio between power supply voltage and discharge maintenance voltage, the voltage applied to the second winding during a period of discharge maintenance control can be set to be lower than the voltage applied by the voltage application unit. During discharge maintenance control, the primary current can be thereby repeatedly supplied to the secondary winding from the voltage application unit, and each time the secondary current flows to the ignition plug. As a result, the spark discharge generated in the ignition plug can be maintained.

According to an eighteenth disclosure, regarding any one of the third, fourteenth, and fifteenth disclosures, the system includes a secondary current detection unit (L2, 30) that detects a secondary current flowing to the ignition plug; and while performing the discharge maintenance control, the ignition control circuit controls the third switching element to be in a closed state when an absolute value of the secondary current detected by the secondary current detection unit becomes smaller than a first threshold value, and the ignition control circuit controls the third switching element to be in an open state when the absolute value of the secondary current detected by the secondary current detection unit becomes larger than a second threshold value, which is set to be larger than the first threshold value.

According to a nineteenth disclosure, regarding the fourth or seventh disclosure, the system includes a secondary current detection unit (L2, 30) that detects a secondary current flowing to the ignition plug; and while performing the discharge maintenance control, the ignition control circuit controls the second switching element to be in a closed state when an absolute value of the secondary current detected by the secondary current detection unit becomes smaller than a first threshold value, and the ignition control circuit controls the second switching element to be in an open state when the absolute value of the secondary current detected by the secondary current detection unit becomes larger than a second threshold value, which is set to be larger than the first threshold value.

By providing a current circulation path, both of the control according to the eighteenth disclosure and the control according to the nineteenth disclosure can slow the decrease in the secondary current during interruption of the primary current. Thus, it is easy to make the absolute value of the secondary current within the range from the first threshold value to the second threshold value. That is, by performing feedback control with the secondary current, it is possible to accurately control the secondary current within a desired range. In addition, it is also possible to reduce rapid changes in the secondary current, and to reduce a discharge spark blowout phenomenon etc., due to the rapid decrease in the secondary current.

According to a twentieth disclosure, regarding any one of the first to fourth disclosures, the first switching element, the second switching element, the third switching element, the ignition control circuit, and the current circulation path are accommodated in a case (50) in which the ignition coil is accommodated.

The first switching element, the second switching element, the third switching element, the ignition control circuit, and the current circulation unit are accommodated in a space in which the ignition coil of the ignition plug is accommodated. That is, the present internal combustion engine ignition system can be accommodated in a space in which the ignition coil of the ignition plug is accommodated. Accordingly, the wiring can be reduced, and the enlargement of the present internal combustion engine ignition system can be suppressed, so that vehicle mountability can be improved.

According to a twenty-first disclosure, regarding any one of the fifth to seventh disclosures, the first switching element, the second switching element, the ignition control circuit, and the current circulation path are accommodated in a case (50) in which the ignition coil is accommodated.

The first switching element, the second switching element, the ignition control circuit, and the current circulation unit are accommodated in a space in which the ignition coil of the ignition plug is accommodated. That is, the present internal combustion engine ignition system can be accommodated in a space in which the ignition coil of the ignition plug is accommodated. Accordingly, the wiring can be reduced, and the enlargement of the present internal combustion engine ignition system can be suppressed, so that vehicle mountability can be improved.

According to a twenty-second disclosure, regarding any one of the tenth to fifteenth disclosures, the first switching element, the third switching element, the ignition control circuit, and the current circulation path are accommodated in a case (50) in which the ignition coil is accommodated.

The first switching element, the third switching element, the ignition control circuit, and the current circulation unit are accommodated in a space in which the ignition coil of the ignition plug is accommodated. That is, the present internal combustion engine ignition system can be accommodated in a space in which the ignition coil of the ignition plug is accommodated. Accordingly, the wiring can be reduced, and the enlargement of the present internal combustion engine ignition system can be suppressed, so that vehicle mountability can be improved.

According to a twenty-third disclosure, regarding any one of the first to twenty-second disclosures, a fifth diode (15D) is connected in reverse parallel to the first switching element.

In any one of the first to twenty-second ignition systems, if the discharge maintenance control is performed in the absence of a current circulation path, the primary current flowing to the second winding and then flowing from the second winding to the second switching element is circulated via the fifth diode connected in reverse parallel to the first switching element, and the first winding. In this case, the amount of the circulating current is reduced by the influence of the first winding, and the secondary current generated in the secondary coil is reduced accordingly. Thus, the controllability may be reduced. In this respect, since the internal combustion engine ignition system according to any one of the first to twenty-second disclosures is provided with a current circulation path, the current is circulated to the second winding via the current circulation path during discharge maintenance control, without passing through the first winding. This makes it possible to suppress a rapid decrease in the secondary current flowing to the ignition plug. Thus, the present ignition system is considered to be suitable for a configuration in which a fifth diode is connected in reverse parallel to the first switching element.

According to a twenty-fourth disclosure, regarding any one of the first to twenty-third disclosures, the internal combustion engine is a multi-cylinder internal combustion engine; the ignition control circuit is provided in each cylinder of the internal combustion engine; the system includes a control device (61) that outputs current control signals for controlling a current flowing to the secondary coil in the discharge maintenance control; the control device is connected to a first common signal line (52) and a second common signal line (53), both transmitting the current control signals; signal lines (52*a* to 52*c*) branching from the first common signal line are each connected to the ignition control circuit of each cylinder of a first cylinder group, which is a group of cylinders (#1, #3, and #5) in which ignition is not continually caused by the ignition plug; and signal lines (53*a* to 53*c*) branching from the second common signal line are each connected to the ignition control circuit of each cylinder of a second cylinder group, which is a group of cylinders (#2, #4, and #6) in which ignition is not continually caused by the ignition plug, and which are not included in the first cylinder group.

When the internal combustion engine is a multi-cylinder internal combustion engine (e.g., an internal combustion engine with five or more cylinders), if current control signals for controlling the current flowing to the secondary coil are common in all of the cylinders, some of the current control signals may overlap in cylinders in which ignition is continually caused by the ignition plug.

In this respect, in the above configuration, the control device outputs current control signals for controlling the current flowing to the secondary coil in discharge maintenance control. The control device is connected to a first common signal line and a second common signal line, both transmitting the current control signals. Signal lines branching from the first common signal line are each connected to the ignition control circuit of each cylinder of a first cylinder group, which is a group of cylinders in which ignition is not continually caused by the ignition plug. Accordingly, ignition in the cylinders of the first cylinder group does not continue, and overlapping of some of the current control signals transmitted to the cylinders of the first cylinder group can be suppressed. Further, signal lines branching from the second common signal line are each connected to the ignition control circuit of each cylinder of a second cylinder group, which is a group of cylinders in which ignition is not continually caused by the ignition plug, and which are not included in the first cylinder group. Accordingly, ignition in the cylinders of the second cylinder group does not continue, and overlapping of some of the current control signals transmitted to the cylinders of the second cylinder group can be suppressed. Therefore, even when the internal combustion engine is a multi-cylinder internal combustion engine, the current flowing to the secondary coil can be controlled by current control signals.

Specifically, in a twenty-fifth disclosure, while the ignition is performed in tandem in two cylinders included in the first cylinder group, the ignition is performed in one cylinder included in the second cylinder group.

While ignition is performed in tandem in two cylinders included in the first cylinder group, ignition is performed in one cylinder included in the second cylinder group, whereby the ignition in the cylinders of the first cylinder group can be made discontinuous, and the ignition in the cylinders of the second cylinder group can be made discontinuous.

What is claimed is:

1. An internal combustion engine ignition system, comprising:

an ignition plug that generates a spark discharge for igniting a combustible mixture in a combustion chamber of an internal combustion engine);

an ignition coil comprising a primary coil and a secondary coil, and applying a voltage to the ignition plug by the secondary coil;

a voltage application unit that applies a predetermined voltage to the primary coil;

a third switching element conducting and interrupting a primary current flowing from the voltage application unit to a center tap provided in the middle of a winding that forms the primary coil;

a first switching element connected between a ground side and one end of the winding forming the primary coil on a side of a first winding, which is a winding from the center tap to one end;

a second switching element connected between the ground side and one end of the winding forming the primary coil on a side of a second winding, which is a winding from the center tap to the other end;

an ignition control circuit that controls open and closed states of the first switching element, open and closed states of the second switching element, and open and closed states of the third switching element, thereby conducting and interrupting the primary current flowing to the first winding to perform discharge generation control that allows the ignition plug to generate the spark discharge, and thereby conducting and interrupting the primary current flowing to the second winding to perform discharge maintenance control that maintains the spark discharge generated in the ignition plug; and a current circulation path that circulates a current flowing from the second winding to the second switching element.

2. The internal combustion engine ignition system according to claim 1, wherein the current circulation path comprises a first diode, a cathode side of the first diode is connected to the center tap, and an anode side of the first diode is connected to the ground side.

3. The internal combustion engine ignition system according to claim 1, wherein the ignition control circuit conducts and interrupts the primary current flowing to the first winding by controlling the second switching element to be in an open state, then controlling the first switching element and the third switching element to be in closed states, and thereafter controlling the first switching element to be in an open state; and the ignition control circuit conducts and circulates the primary current flowing to the second winding by controlling the first switching element to be in an open state, then controlling the second switching element and the third switching element to be in closed states, and thereafter controlling the third switching element to be in an open state.

4. The internal combustion engine ignition system according to claim 1, wherein the ignition control circuit conducts and interrupts the primary current flowing to the first winding by controlling the second switching element to be in an open state, then controlling the first switching element and the third switching element to be in closed states, and thereafter controlling the first switching element to be in an open state; and the ignition control circuit conducts and interrupts the primary current flowing to the second winding by controlling the first switching element to be in an open state, then controlling the second switching element and the third switching element to be in closed states, and thereafter controlling the second switching element to be in an open state.

5. An internal combustion engine ignition system, comprising:

an ignition plug that generates a spark discharge for igniting a combustible mixture in a combustion chamber of an internal combustion engine;

an ignition coil comprising a primary coil and a secondary coil, and applying a voltage to the ignition plug by the secondary coil;

a voltage application unit applying a predetermined voltage to a center tap provided in the middle of a winding that forms the primary coil;

a first switching element connected between a ground side and one end of the winding forming the primary coil on a side of a first winding, which is a winding from the center tap to one end;

a second switching element connected between the ground side and one end of the winding forming the primary coil on a side of a second winding, which is a winding from the center tap to the other end;

an ignition control circuit that controls open and closed states of the first switching element and open and closed states of the second switching element, thereby conducting and interrupting a primary current flowing to the first winding to perform discharge generation control that allows the ignition plug to generate the spark discharge, and thereby conducting and interrupting the primary current flowing to the second winding to perform discharge maintenance control that maintains the spark discharge generated in the ignition plug; and a current circulation path that circulates a current flowing to the second winding when the current flowing to the second winding is interrupted by opening and closing operation of the second switching element.

6. The internal combustion engine ignition system according to claim 5, wherein the current circulation path comprises a second diode, a cathode side of the second diode is connected to a current path between the voltage application unit and the center tap, and an anode side of the second diode is connected to a current path between the second winding and the second switching element.

7. The internal combustion engine ignition system according to claim 5, wherein as the discharge generation control, the ignition control circuit conducts and interrupts a primary current flowing to the first winding by controlling the second switching element to be in an open state, then controlling the first switching element to be in a closed state, and thereafter controlling the first switching element to be in an open state; and as the discharge maintenance control, the ignition control circuit conducts and circulates the primary current flowing to the second winding by controlling the first switching element to be in an open state, then controlling the second switching element to be in a closed state, and thereafter controlling the second switching element to be in an open state.

8. The internal combustion engine ignition system according to claim 1, further comprising a third diode, a cathode side of which is connected to the second switching element, and an anode side of which is connected to an end on a side opposite to the center tap side.

9. The internal combustion engine ignition system according to claim 1, further comprising a third diode, a cathode side of which is connected to the center tap, and an anode side of which is connected to the voltage application unit.

10. An internal combustion engine ignition system, comprising:

an ignition plug that generates a spark discharge for igniting a combustible mixture in a combustion chamber of an internal combustion engine;

an ignition coil comprising a primary coil and a secondary coil, and applying a voltage to the ignition plug by the secondary coil;

a voltage application unit applying a predetermined voltage to a center tap provided in the middle of a winding that forms the primary coil;

a first switching element connected between a ground side and one end of the winding forming the primary coil on a side of a first winding, which is a winding from the center tap to one end;

a third switching element connected between the center tap and a second winding, which is a winding from the center tap to the other end;

an ignition control circuit that controls open and closed states of the first switching element and open and closed states of the third switching element, thereby performing discharge generation control that allows the ignition plug to generate the spark discharge, and thereby performing discharge maintenance control that maintains the spark discharge generated in the ignition plug; and a current circulation path that circulates a current flowing from the second winding to the ground side.

11. The internal combustion engine ignition system according to claim 10, wherein the current circulation path comprises a fourth diode, a cathode side of which is connected to a current path between the third switching element and the second winding, and an anode side of which is connected to the ground side.

12. The internal combustion engine ignition system according to claim 10, further comprising a third diode, a cathode side of which is connected to the ground side, and an anode side of which is connected to an end of the second winding on a side opposite to the center tap side.

13. The internal combustion engine ignition system according to claim 10, further comprising a third diode, a cathode side of which is connected to an end of the second winding on the center tap side, and an anode side of which is connected to the third switching element.

14. The internal combustion engine ignition system according to claim 10, wherein as the discharge generation control, the ignition control circuit conducts and interrupts a primary current flowing to the first winding by controlling the third switching element to be in an open state, then controlling the first switching element to be in a closed state, and thereafter controlling the first switching element to be in an open state; and as the discharge maintenance control, the ignition control circuit conducts and circulates the primary current flowing to the second winding by controlling the first switching element to be in an open state, then controlling the third switching element to be in a closed state, and thereafter controlling the third switching element to be in an open state.

15. The internal combustion engine ignition system according to claim 10, wherein as the discharge generation control, the ignition control circuit conducts and interrupts a primary current flowing to the first winding and the second winding by controlling the first switching element and the third switching element to be in closed states, and then controlling the first switching element and the third switching element to be in open states; and as the discharge maintenance control, the ignition control circuit conducts and circulates the primary current flowing to the second winding by controlling the first switching element to be in an open state, then controlling the third switching element to be in a closed state, and thereafter controlling the third switching element to be in an open state.

16. The internal combustion engine ignition system according to claim 1, wherein the number of turns of the first winding is greater than the number of turns of the second winding.

17. The internal combustion engine ignition system according to claim 1, wherein a turn ratio, which is a value obtained by dividing the number of turns of the secondary coil by the number of turns of the second winding, is larger than a voltage ratio, which is a value obtained by dividing a discharge maintenance voltage as a voltage required to maintain the spark discharge generated in the ignition plug by the discharge generation control, by the voltage applied by the voltage application unit.

18. The internal combustion engine ignition system according to claim 3, further comprises a secondary current detection unit that detects a secondary current flowing to the ignition plug, wherein while performing the discharge maintenance control, the ignition control circuit controls the third switching element to be in a closed state when an absolute value of the secondary current detected by the secondary current detection unit becomes smaller than a first threshold value, and the ignition control circuit controls the third switching element to be in an open state when the absolute value of the secondary current detected by the secondary current detection unit becomes larger than a second threshold value, which is set to be larger than the first threshold value.

19. The internal combustion engine ignition system according to claim 4, further comprising a secondary current detection unit that detects a secondary current flowing to the ignition plug, wherein while performing the discharge maintenance control, the ignition control circuit controls the second switching element to be in a closed state when an absolute value of the secondary current detected by the secondary current detection unit becomes smaller than a first threshold value, and the ignition control circuit controls the second switching element to be in an open state when the absolute value of the secondary current detected by the secondary current detection unit becomes larger than a second threshold value, which is set to be larger than the first threshold value.

20. The internal combustion engine ignition system according to claim 1, wherein the first switching element, the second switching element, the third switching element, the ignition control circuit, and the current circulation path are accommodated in a case in which the ignition coil is accommodated.

21. The internal combustion engine ignition system according to claim 5, wherein the first switching element, the second switching element, the ignition control circuit, and the current circulation path are accommodated in a case in which the ignition coil is accommodated.

22. The internal combustion engine ignition system according to claim 10, wherein the first switching element, the third switching element, the ignition control circuit, and the current circulation path are accommodated in a case in which the ignition coil is accommodated.

23. The internal combustion engine ignition system according to claim 1, wherein a fifth diode is connected in reverse parallel to the first switching element.

24. The internal combustion engine ignition system according to claim 1, wherein the internal combustion engine is a multi-cylinder internal combustion engine, the ignition control circuit is provided in each cylinder of the internal combustion engine, the system further comprises a control device that outputs current control signals for controlling a current flowing to the secondary coil in the discharge maintenance control, the control device is connected to a first common signal line and a second common signal line, both transmitting the current control signals, signal lines branching from the first common signal line are each connected to the ignition control circuit of each cylinder of a first cylinder group, which is a group of cylinders in which ignition is not continually caused by the ignition plug; and signal lines branching from the second common signal line are each connected to the ignition control circuit of each cylinder of a second cylinder group, which is a group of cylinders in which ignition is not continually caused by the ignition plug, and which are not included in the first cylinder group.

25. The internal combustion engine ignition system according to claim 24, wherein while the ignition is performed in tandem in two cylinders included in the first cylinder group, the ignition is performed in one cylinder included in the second cylinder group.

26. The internal combustion engine ignition system according to claim 5, further comprising a third diode, a cathode side of which is connected to the second switching element, and an anode side of which is connected to an end on a side opposite to the center tap side.

27. The internal combustion engine ignition system according to claim 5, further comprising a third diode, a cathode side of which is connected to the center tap, and an anode side of which is connected to the voltage application unit.

28. The internal combustion engine ignition system according to claim 5, wherein the number of turns of the first winding is greater than the number of turns of the second winding.

29. The internal combustion engine ignition system according to claim 10, wherein the number of turns of the first winding is greater than the number of turns of the second winding.

30. The internal combustion engine ignition system according to claim 5, wherein a turn ratio, which is a value obtained by dividing the number of turns of the secondary coil by the number of turns of the second winding, is larger than a voltage ratio, which is a value obtained by dividing a discharge maintenance voltage as a voltage required to maintain the spark discharge generated in the ignition plug by the discharge generation control, by the voltage applied by the voltage application unit.

31. The internal combustion engine ignition system according to claim 10, wherein a turn ratio, which is a value obtained by dividing the number of turns of the secondary coil by the number of turns of the second winding, is larger than a voltage ratio, which is a value obtained by dividing a discharge maintenance voltage as a voltage required to maintain the spark discharge generated in the ignition plug by the discharge generation control, by the voltage applied by the voltage application unit.

32. The internal combustion engine ignition system according to claim 14, further comprises a secondary current detection unit that detects a secondary current flowing to the ignition plug, wherein while performing the discharge maintenance control, the ignition control circuit controls the third switching element to be in a closed state when an absolute value of the secondary current detected by the secondary current detection unit becomes smaller than a first threshold value, and the ignition control circuit controls the third switching element to be in an open state when the absolute value of the secondary current detected by the secondary current detection unit becomes larger than a second threshold value, which is set to be larger than the first threshold value.

33. The internal combustion engine ignition system according to claim 7, further comprising a secondary current detection unit that detects a secondary current flowing to the ignition plug, wherein while performing the discharge maintenance control, the ignition control circuit controls the second switching element to be in a closed state when an absolute value of the secondary current detected by the secondary current detection unit becomes smaller than a first threshold value, and the ignition control circuit controls the second switching element to be in an open state when the absolute value of the secondary current detected by the secondary current detection unit becomes larger than a second threshold value, which is set to be larger than the first threshold value.

34. The internal combustion engine ignition system according to claim 5, wherein a fifth diode is connected in reverse parallel to the first switching element.

35. The internal combustion engine ignition system according to claim 10, wherein a fifth diode is connected in reverse parallel to the first switching element.

36. The internal combustion engine ignition system according to claim 5, wherein the internal combustion engine is a multi-cylinder internal combustion engine, the ignition control circuit is provided in each cylinder of the internal combustion engine, the system further comprises a control device that outputs current control signals for controlling a current flowing to the secondary coil in the discharge maintenance control, the control device is connected to a first common signal line and a second common signal line, both transmitting the current control signals, signal lines branching from the first common signal line are each connected to the ignition control circuit of each cylinder of a first cylinder group, which is a group of cylinders in which ignition is not continually caused by the ignition plug; and signal lines branching from the second common signal line are each connected to the ignition control circuit of each cylinder of a second cylinder group, which is a group of cylinders in which ignition is not continually caused by the ignition plug, and which are not included in the first cylinder group.

37. The internal combustion engine ignition system according to claim 10, wherein the internal combustion engine is a multi-cylinder internal combustion engine, the ignition control circuit is provided in each cylinder of the internal combustion engine, the system further comprises a control device that outputs current control signals for controlling a current flowing to the secondary coil in the discharge maintenance control, the control device is connected to a first common signal line and a second common signal line, both transmitting the current control signals, signal lines branching from the first common signal line are each connected to the ignition control circuit of each cylinder of a first cylinder group, which is a group of cylinders in which ignition is not continually caused by the ignition plug; and signal lines branching from the second common signal line are each connected to the ignition control circuit of each cylinder of a second cylinder group, which is a group of cylinders in which ignition is not continually caused by the ignition plug, and which are not included in the first cylinder group.

* * * * *